United States Patent [19]

Herms

[11] 4,018,259

[45] Apr. 19, 1977

[54] JALOUSIE ELEMENT

[75] Inventor: Gunter Herms, Siegburg-Kaldauen, Germany

[73] Assignee: Dynamit Nobel Aktiengesellschaft, Troisdorf, Germany

[22] Filed: June 27, 1974

[21] Appl. No.: 483,838

Related U.S. Application Data

[62] Division of Ser. No. 110,698, Jan. 28, 1971, Pat. No. 3,840,061.

[52] U.S. Cl. ..... 160/26; 160/29; 160/133

[51] Int. Cl.[2] ..... E06B 9/10

[58] Field of Search ..... 160/29, 26, 31, 231, 160/133, 309, 310, 176, 177, 331, 188; 74/606 R

[56] References Cited

UNITED STATES PATENTS

| | | | |
|---|---|---|---|
| 2,492,721 | 12/1949 | Vita | 160/310 X |
| 2,819,628 | 1/1958 | Wardlaw | 160/188 X |
| 3,126,049 | 3/1964 | Hollands | 160/26 X |
| 3,512,302 | 5/1970 | Sivin et al. | 160/133 X |

*Primary Examiner*—Philip C. Kannan
*Attorney, Agent, or Firm*—Walter Becker

[57] ABSTRACT

A closure for a wall opening, such as a window, in which the closure is in the form of a rolling shield adapted to be wound up on a shaft. The shaft is rotatably mounted in a box and the box supports guides for the said edges of the shield so that the entire closure arrangement forms a unit adapted for being mounted on the wall containing the opening to be closed thereby in a simple manner.

3 Claims, 52 Drawing Figures

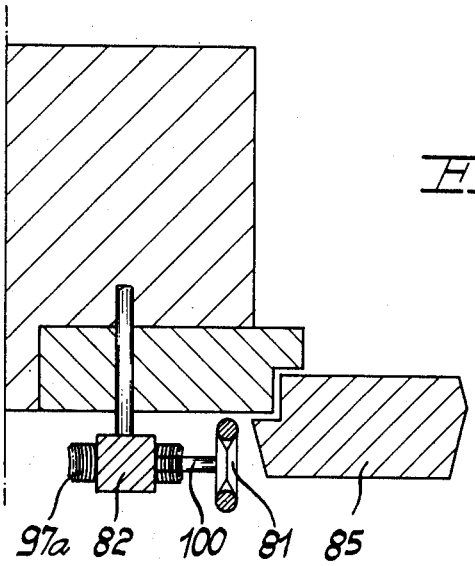
Fig. 27
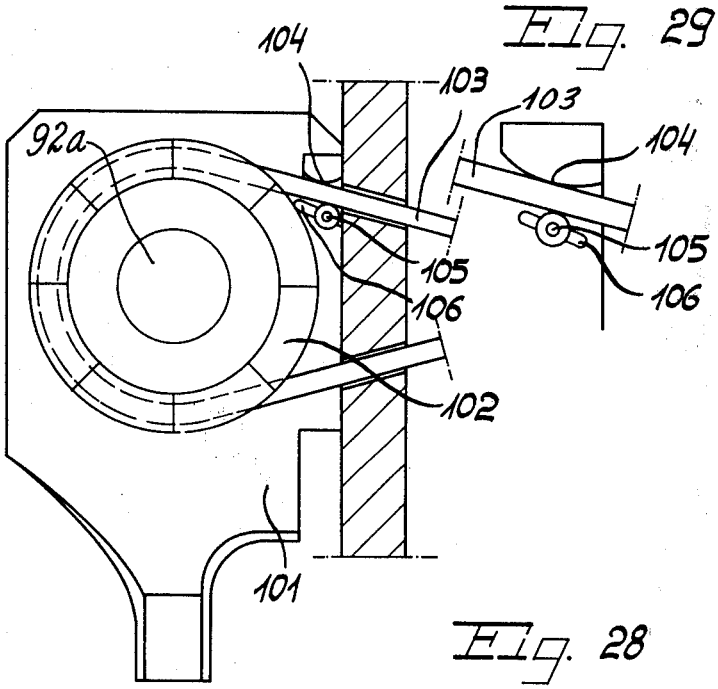
Fig. 29
Fig. 28

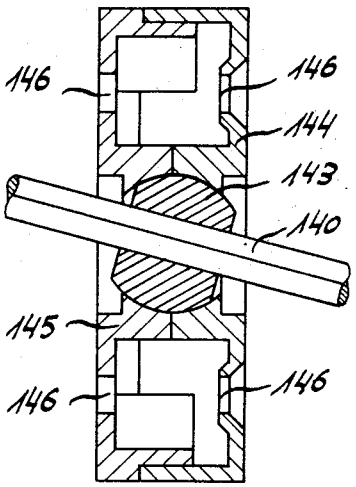
Fig. 35
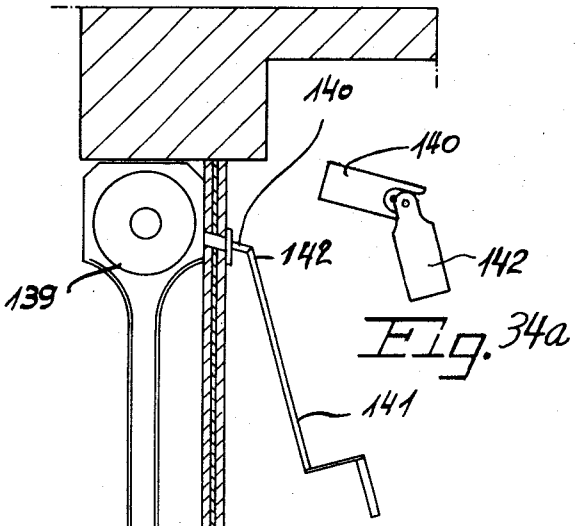
Fig. 34a
Fig. 34
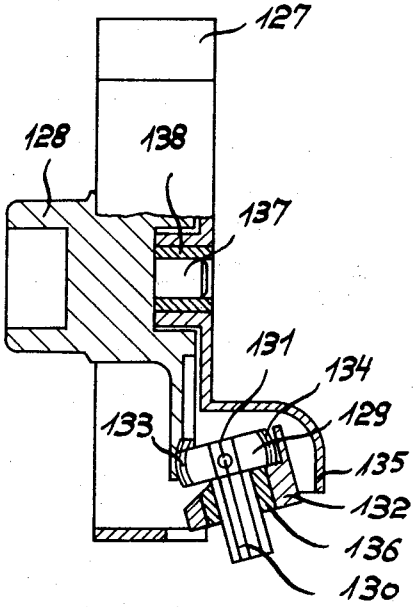
Fig. 33

Fig. 48
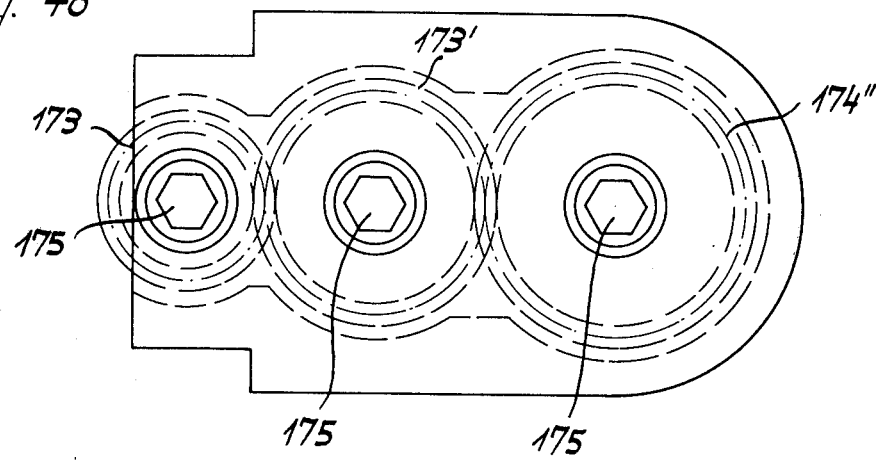
Fig. 49
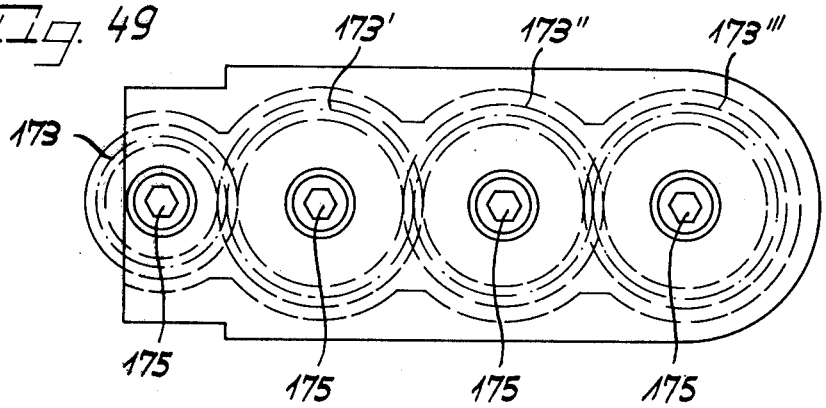
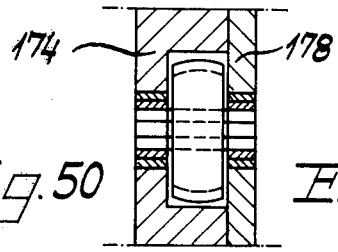
Fig. 50
Fig. 51
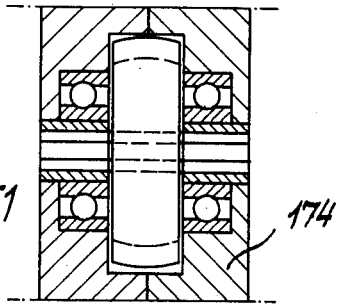

JALOUSIE ELEMENT

This is a division of co-pending application Ser. No. 110,698, filed Jan. 28, 1971 now U.S. Pat. No. 3,840,061 —Herms issued Oct. 8, 1974.

The present invention relates to a jalousie element which can be installed also from the outside and in particular at windows where no jalousie boxes are provided. Heretofore known and employed jalousies are furnished to the building lot in the form of individual elements where they are assembled to form a unit. The side parts of the jalousie box are made of wood or zinc sheet and are screwed together with other parts. The individual elements of the jalousie unit are firmly pressed against the masonry so as to prevent any rain water from entering between the jalousie unit and the masonry.

These assemblies have the drawback that they require considerable assembly time. The employment of sheet metal, wood, or synthetic material formed without forms make it impossible to produce jalousie boxes in mass fabrication or at least make it rather difficult to do so. Frequently the sealing possibilities are insufficient and the connection of the guidling rail with the jalousie box do not contribute to increasing the stability for the jalousie unit.

It is, therefore, an object of the present invention to provide a jalousie element in such a way that practically production on the assembly line remote from the building lot will be possible.

This object and other objects and advantages of the invention will appear more clearly from the following specification, in connection with the accompanying drawings, in which.

Figure 6:
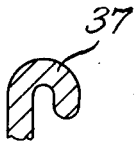
Figure 5:
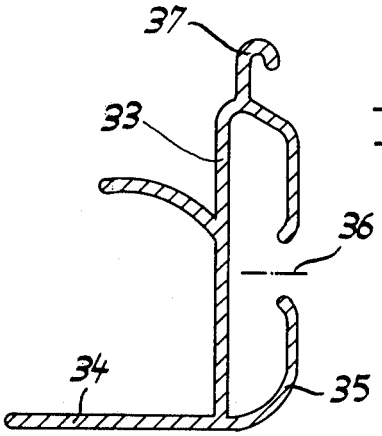
Figure 7:
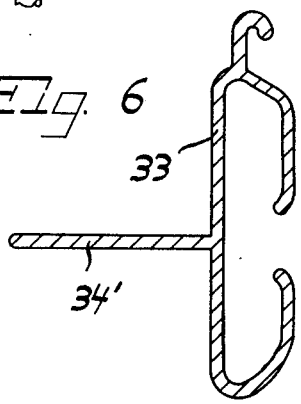

FIGS. 5, 6 and 7 show the construction of the jalousie slat according to the invention. More specifically, FIG. 5 shows a section through the jalousie slat. FIG. 6 shows a connecting hook for the next slat of the jalousie. FIG. 7 illustrates a modification of FIG. 5.

Figure 8:
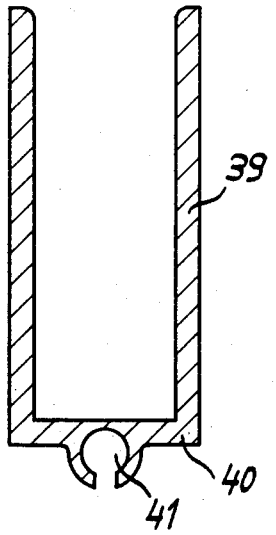

FIG. 8 illustrates the runway rail with an opening therein.

Figure 9:
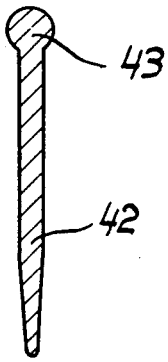

FIG. 9 shows the sealing mass in the form of a strip with a bead connected thereto.

Figure 10:
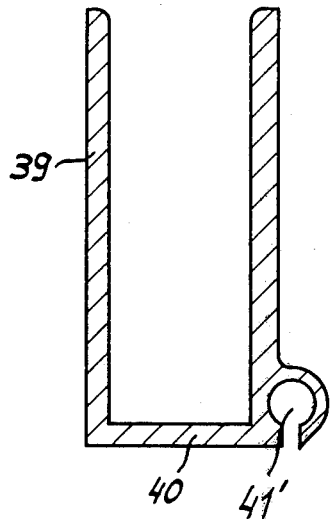

FIG. 10 shows a modified runway rail with an opening laterally of the bottom of said runway rail.

Figure 11:
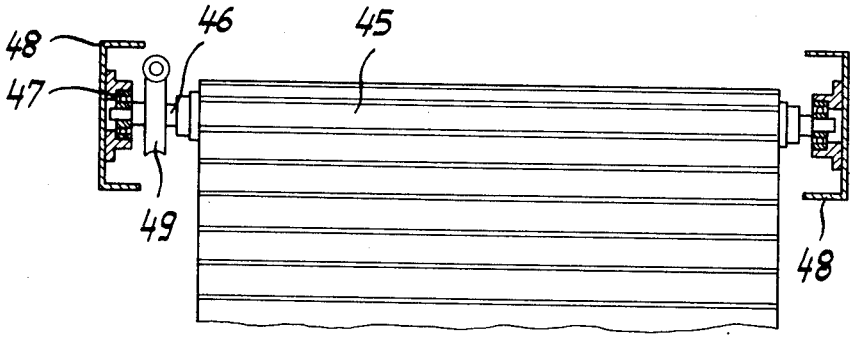

FIG. 11 illustrates a front view of the jalousie element construction.

Figure 12:
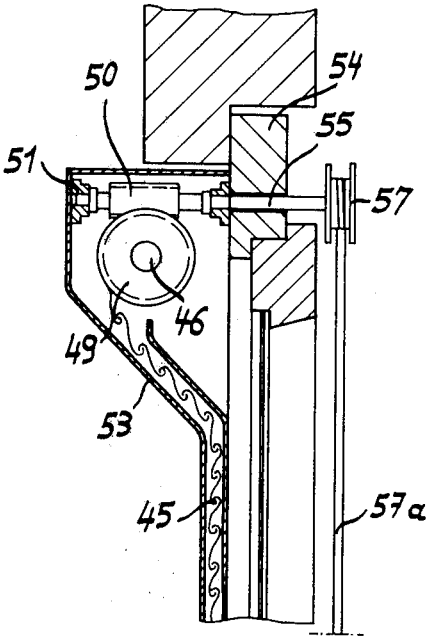

FIG. 12 is a cross section through a jalousie according to the invention with a pulley drive.

Figure 13:
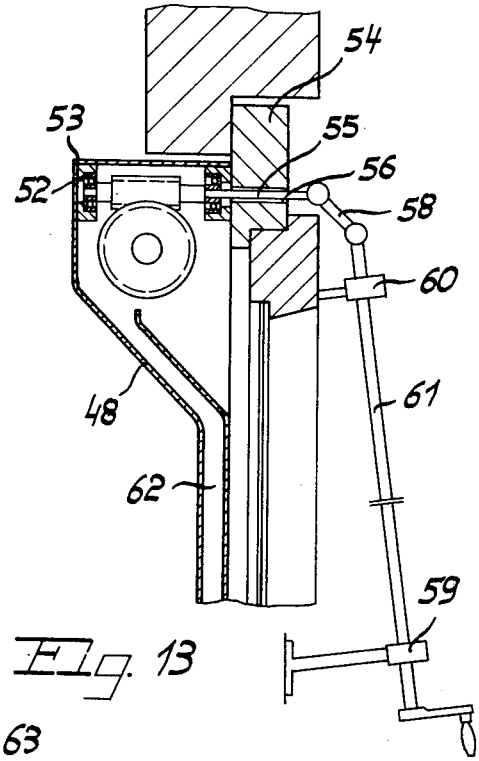

FIG. 13 is a cross section through a jalousie assembly with crankcase drive.

Figure 14:
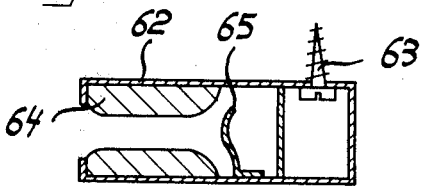

FIG. 14 shows a cross section through different guiding means for the jalousie.

Figure 15:
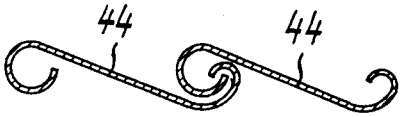

FIG. 15 is a partial section through the jalousie.

Figure 16:
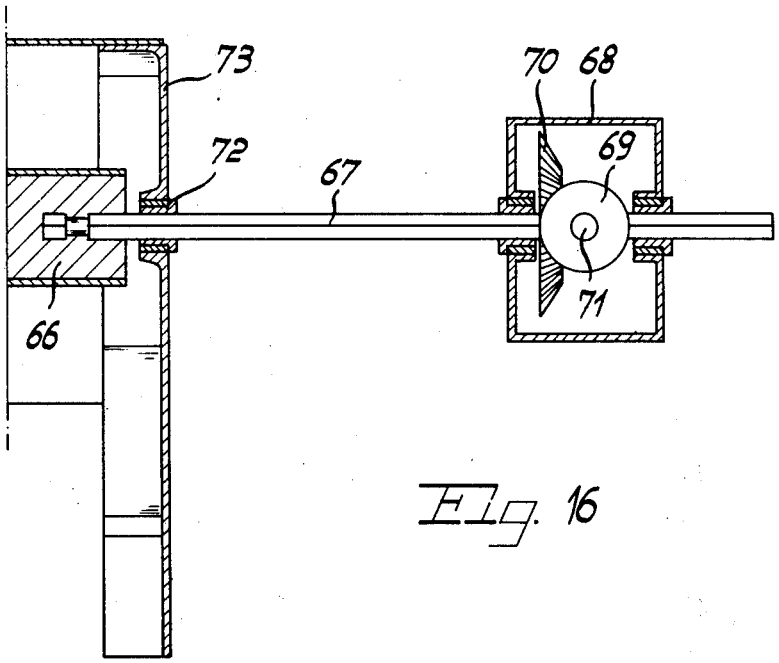

FIG. 16 shows the jalousie shaft with its axis.

Figure 17:
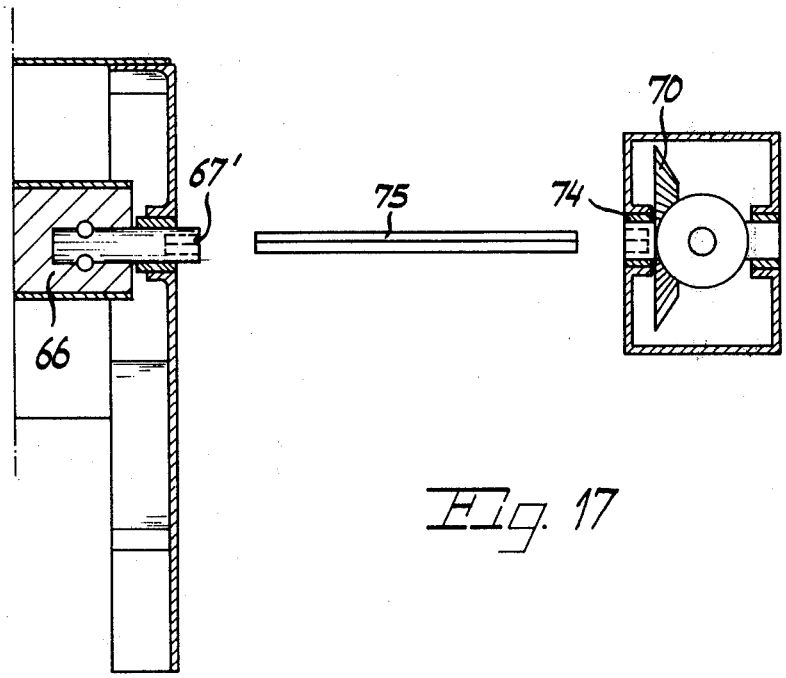

FIG. 17 also shows the jalousie shaft with its axle provided with a bore.

FIG. 18 again shows the jalousie shaft with its axle which, however, over FIGS. 16 and 17, is bored through all the way.

Figure 19:
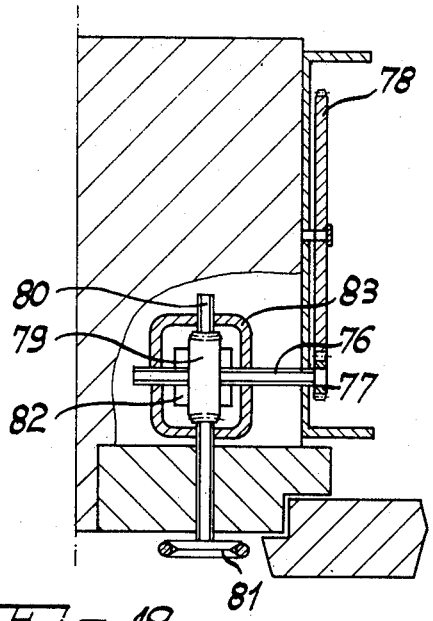

FIG. 19 shows one way of operating the jalousie according to the invention.

Figure 20:
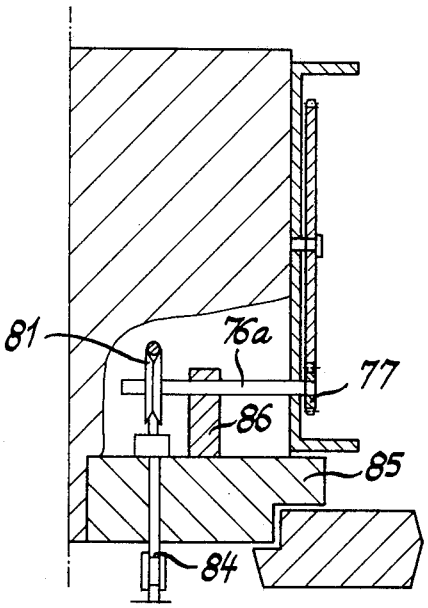

FIG. 20 shows a cord extending through the window frame for turning a small pulley in front of the frame.

Figure 21:
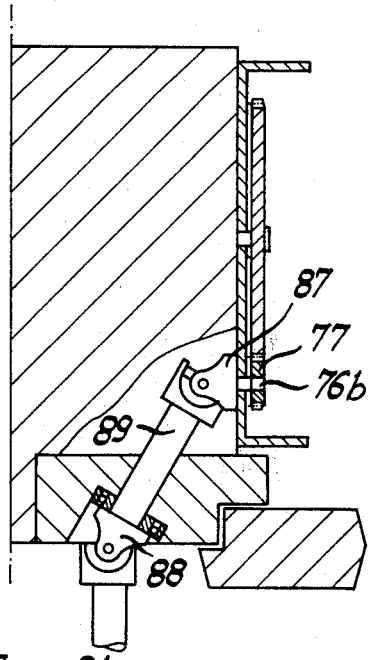

FIG. 21 illustrates two ball cross link joints, the central axis of which may be extended, depending on the thickness of the frame.

Figure 22:
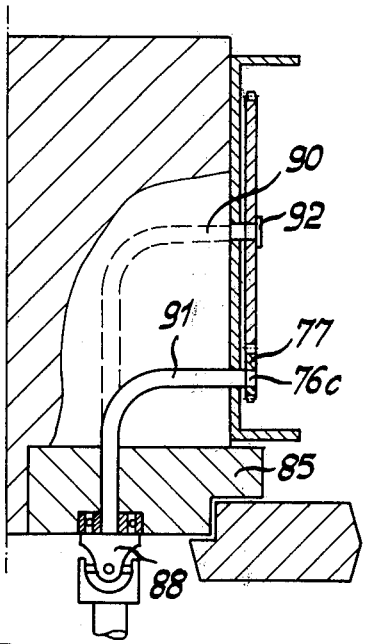

FIG. 22 illustrates in that the cross joint may be replaced by flexible shafts.

Figure 23:
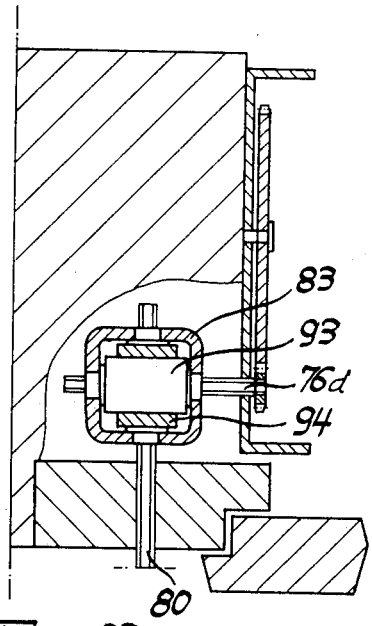

FIG. 23 illustrates how instead of the worm wheels shown in FIG. 11 helical gears may be employed.

Figure 24:
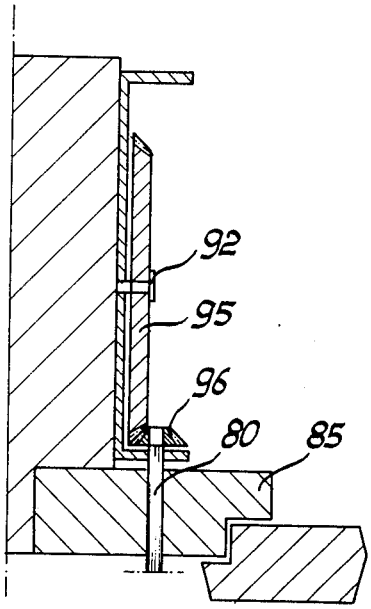

FIG. 24 shows a modification according to which instead of the large spur wheels a large bevel gear may be connected to the axle of the jalousie shaft.

Figure 25:
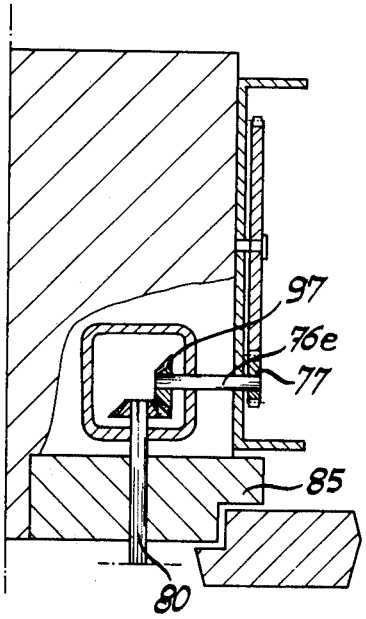

FIG. 25 illustrates a small bevel gear transmission instead of the helical transmission of FIG. 23.

Figure 26:
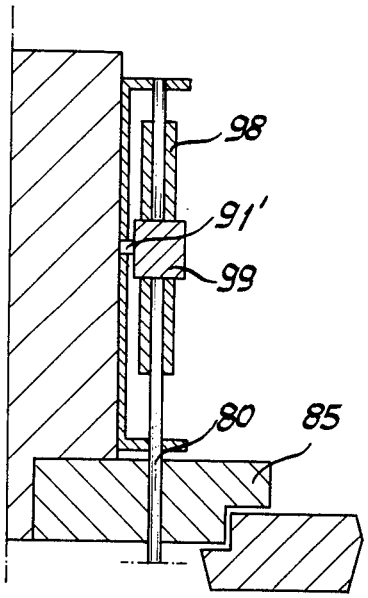

FIG. 26 shows a modification of FIG. 24, inasmuch as instead of the bevel gear transmission a helical gear transmission comprising a large helical wheel and a small helical wheel is provided.

FIG. 27 shows a worm wheel similar to that of FIG. 19, but connected in front of the window frame and inside the room.

FIG. 28 illustrates a side member with a large pulley as fixedly connected directly to the roller axle.

FIG. 29 illustrates a clamping mechanism for use in connection with the present invention.

Figure 30:
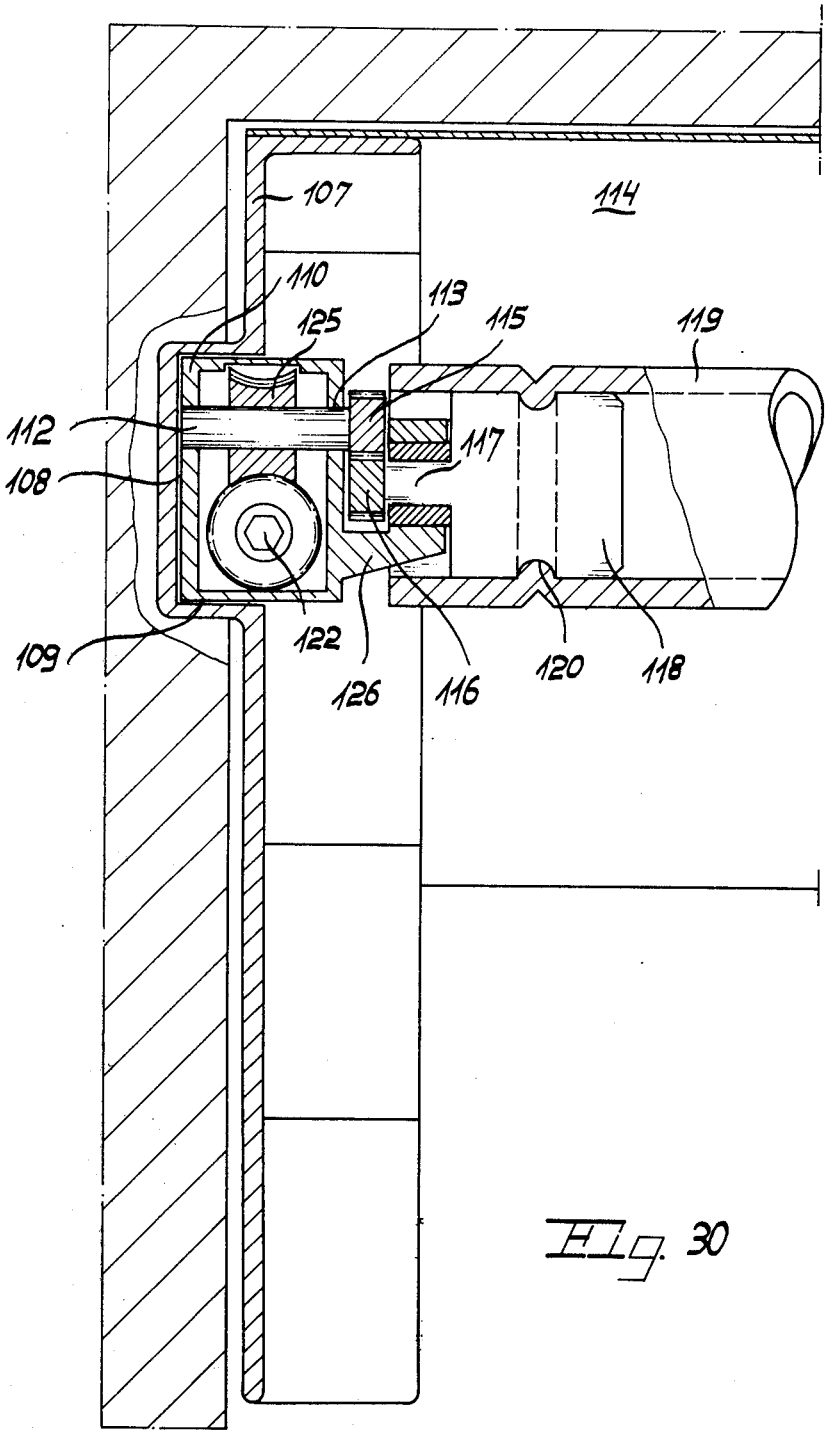

FIG. 30 shows a front view, partly in section, of a jalousie driving device according to the invention.

Figure 31:
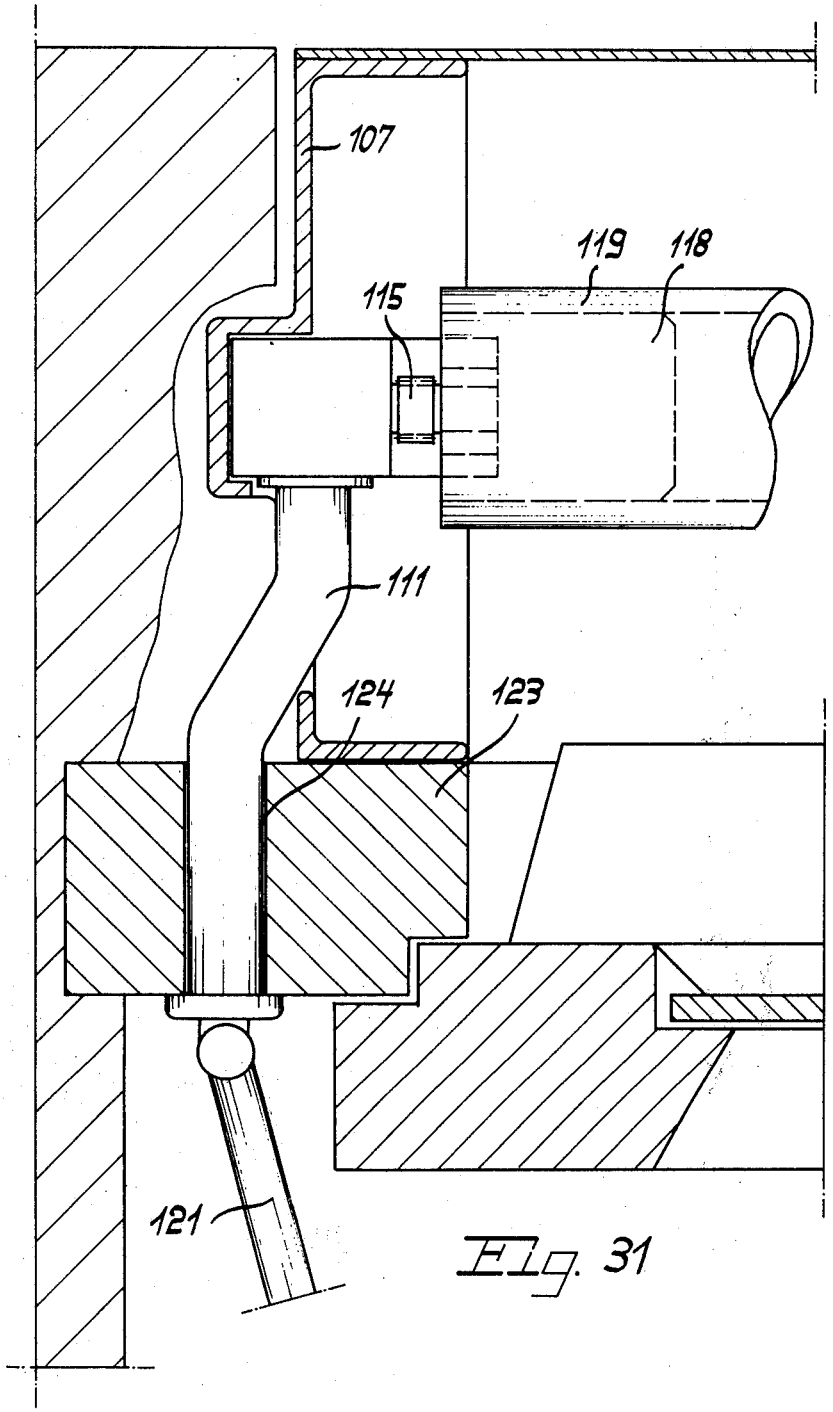

FIG. 31 is a top view partially sectioned of a jalousie driving device according to the invention.

Figure 32:
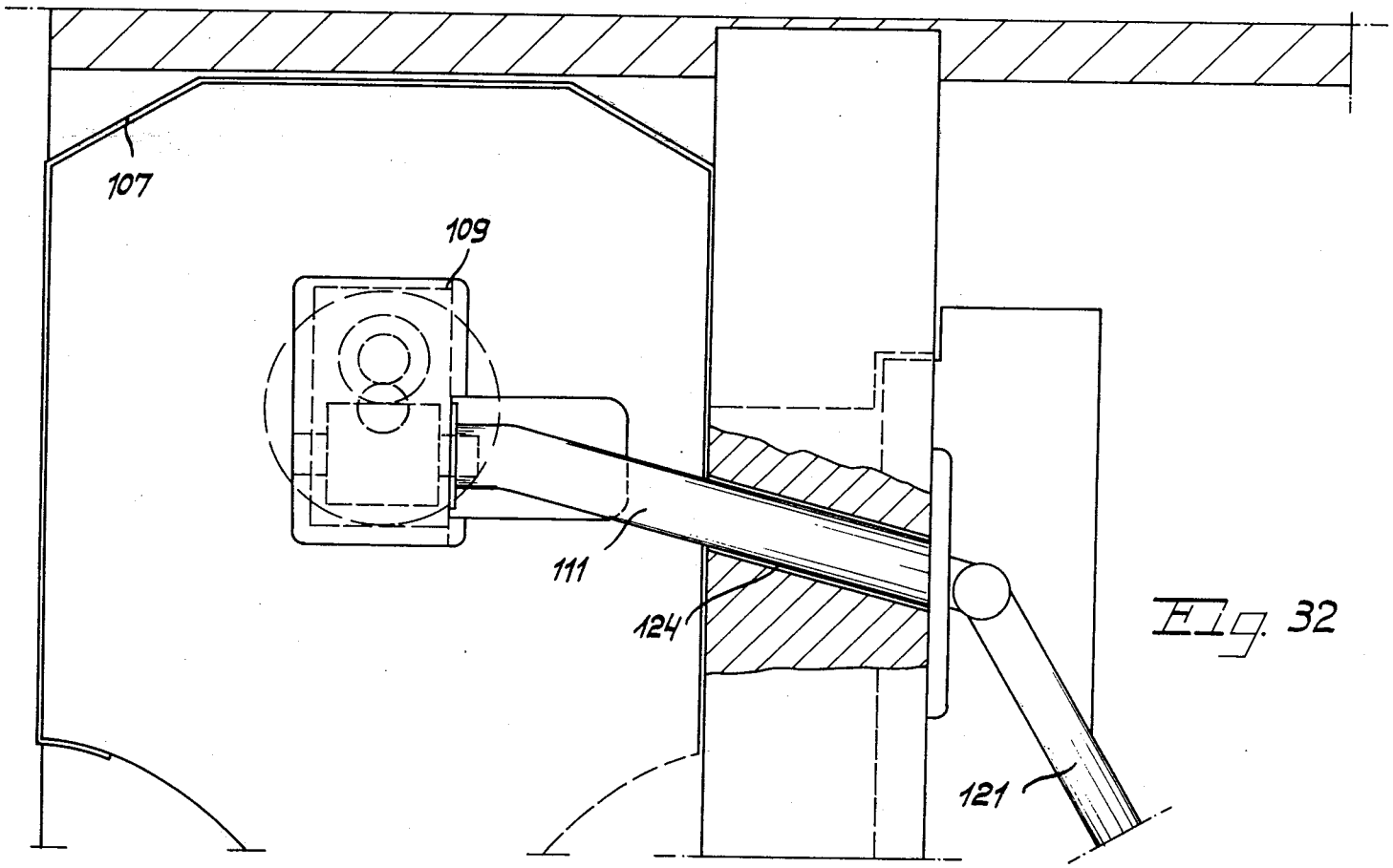

FIG. 32 is a side view and partially in section of a jalousie driving device.

FIG. 33 shows the housing of the transmission and bearing cups for the jalousie box.

FIG. 34 is a section through the jalousie box.

FIG. 34*a* shows a detail of FIG. 34.

FIG. 35 shows the driving shaft extending through the window frame.

Figure 36:
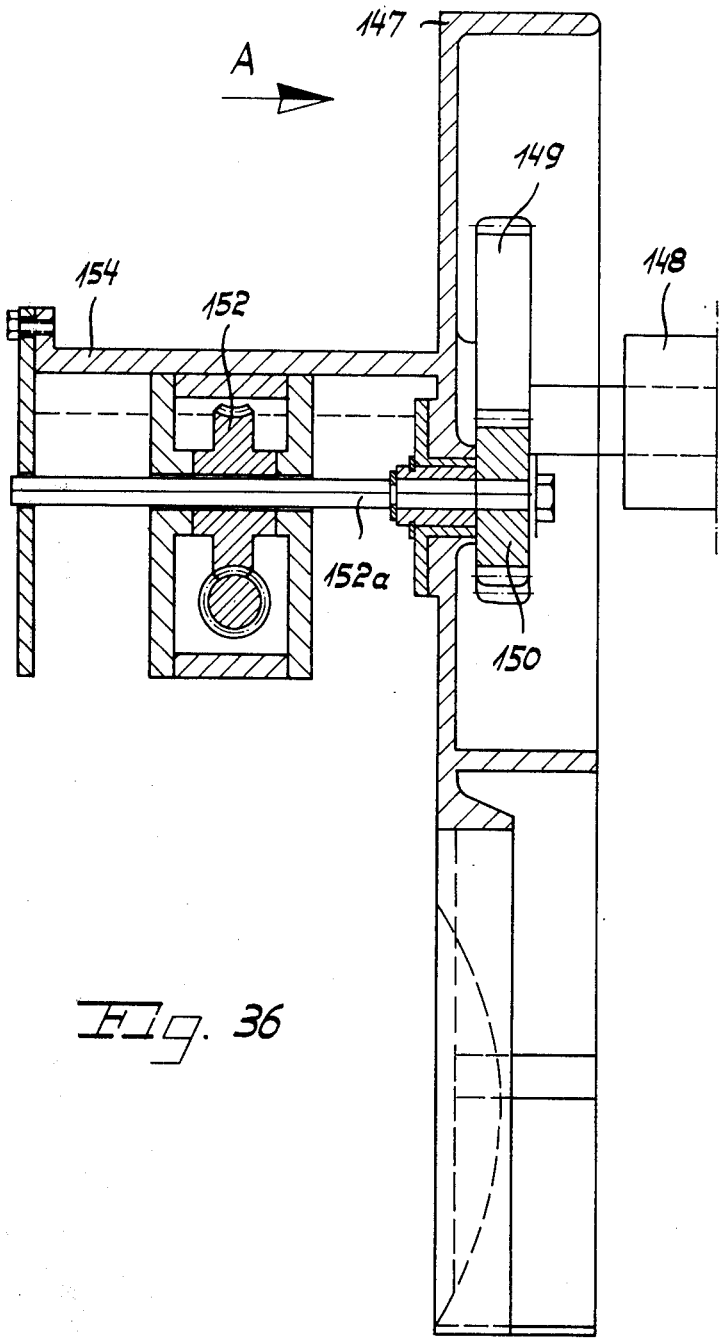

FIG. 36 is a side view, partially in section of a side member for a jalousie.

Figure 37:
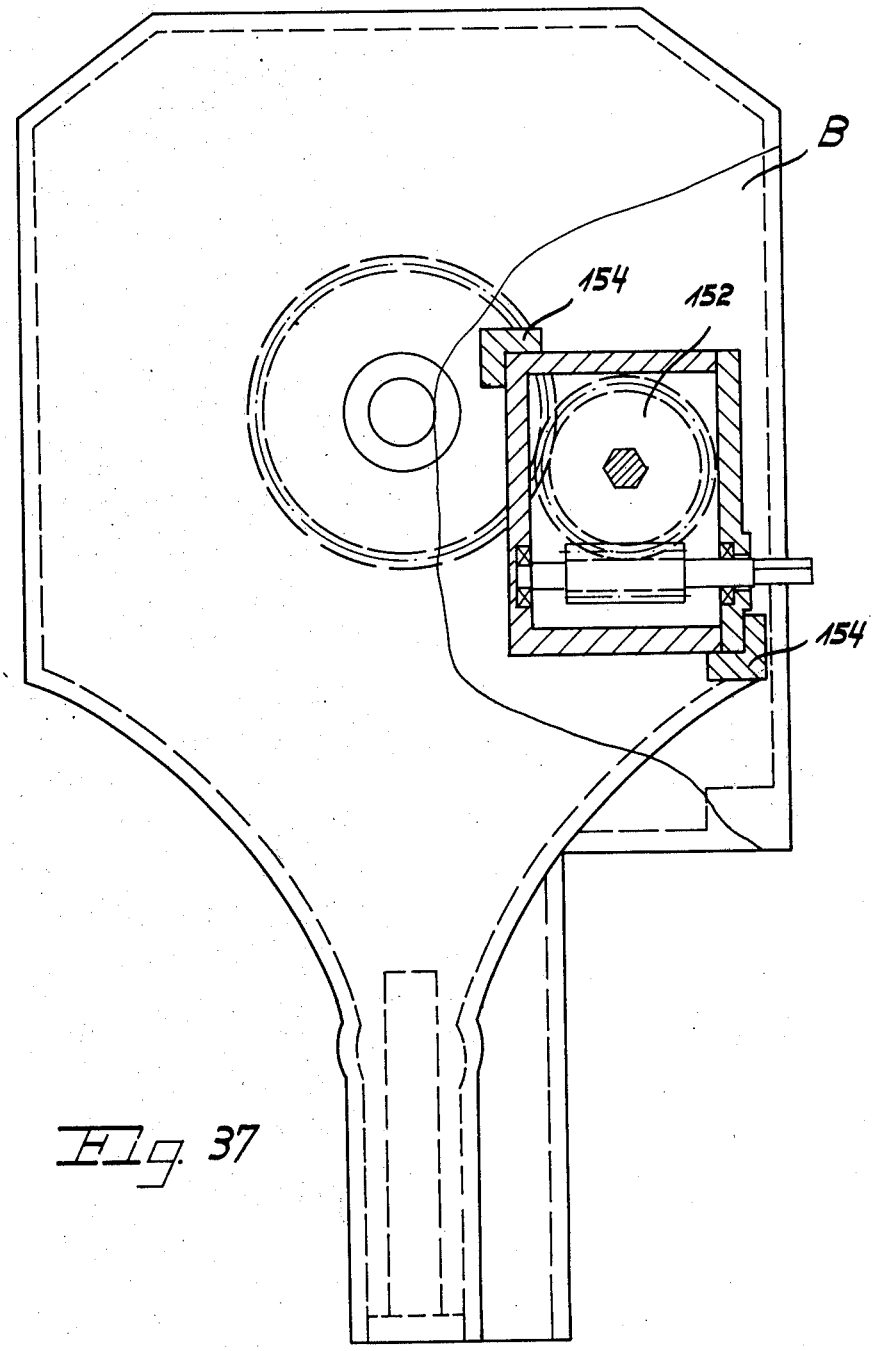

FIG. 37 shows a view seen in the direction of the arrow A of the FIG. 36.

Figure 38:
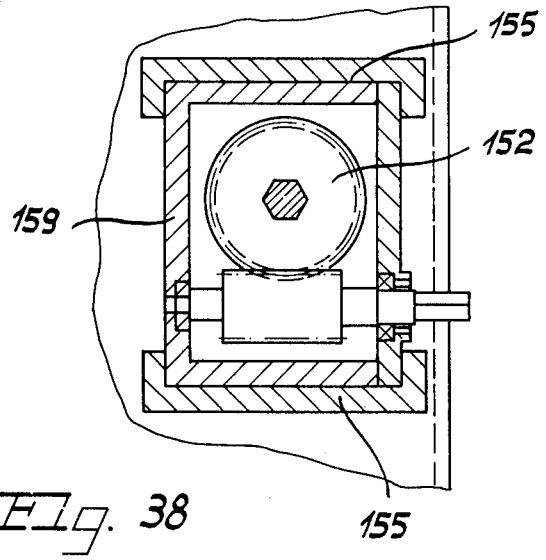

FIG. 38 shows a further embodiment of the invention as sectioned in the region B of FIG. 37.

Figure 39:
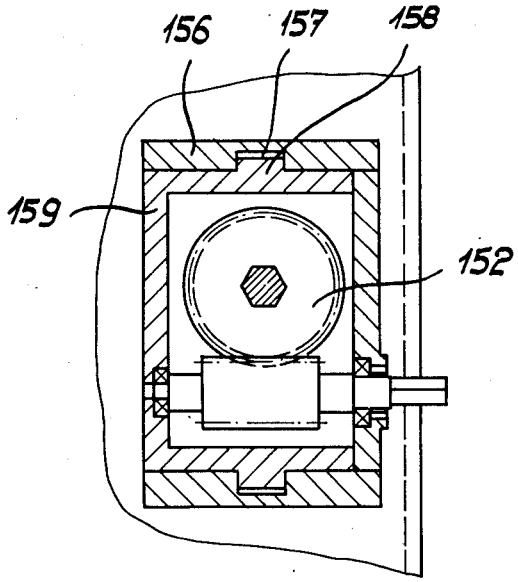

FIG. 39 shows a third possible embodiment of the invention as sectioned in the region B of FIG. 37.

Figure 40:
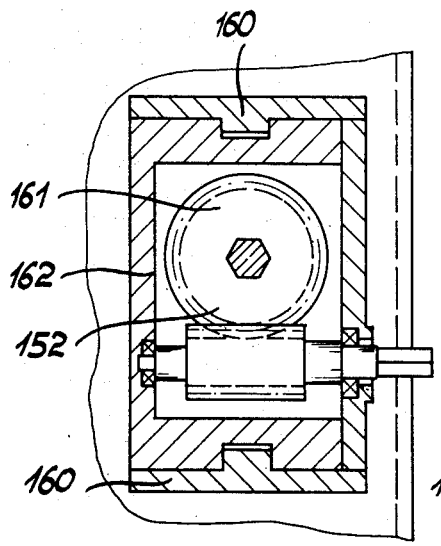

FIG. 40 illustrates a fourth embodiment of the jalousie according to the invention as sectioned in the area B of FIG. 37.

Figure 41:
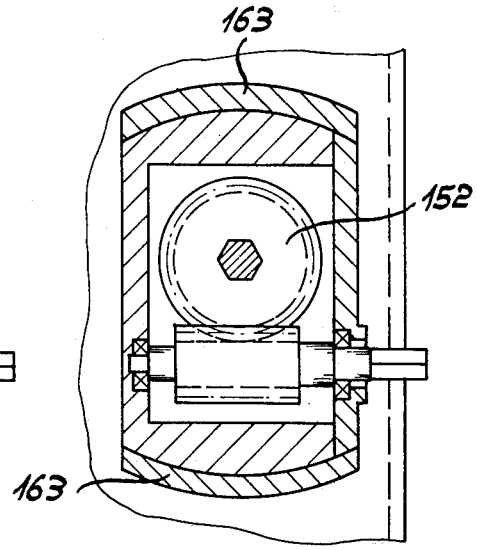

FIG. 41 illustrates a fifth possibility of designing the jalousie according to the invention likewise sectioned in the range B of FIG. 37.

Figure 42:
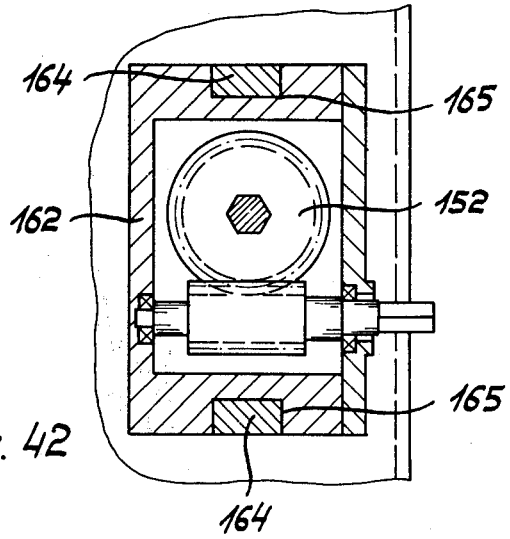

FIG. 42 illustrates a sixth possibility of the jalousie according to the invention, the section likewise is assumed to have been taken in the area of B of FIG. 37.

Figure 43:
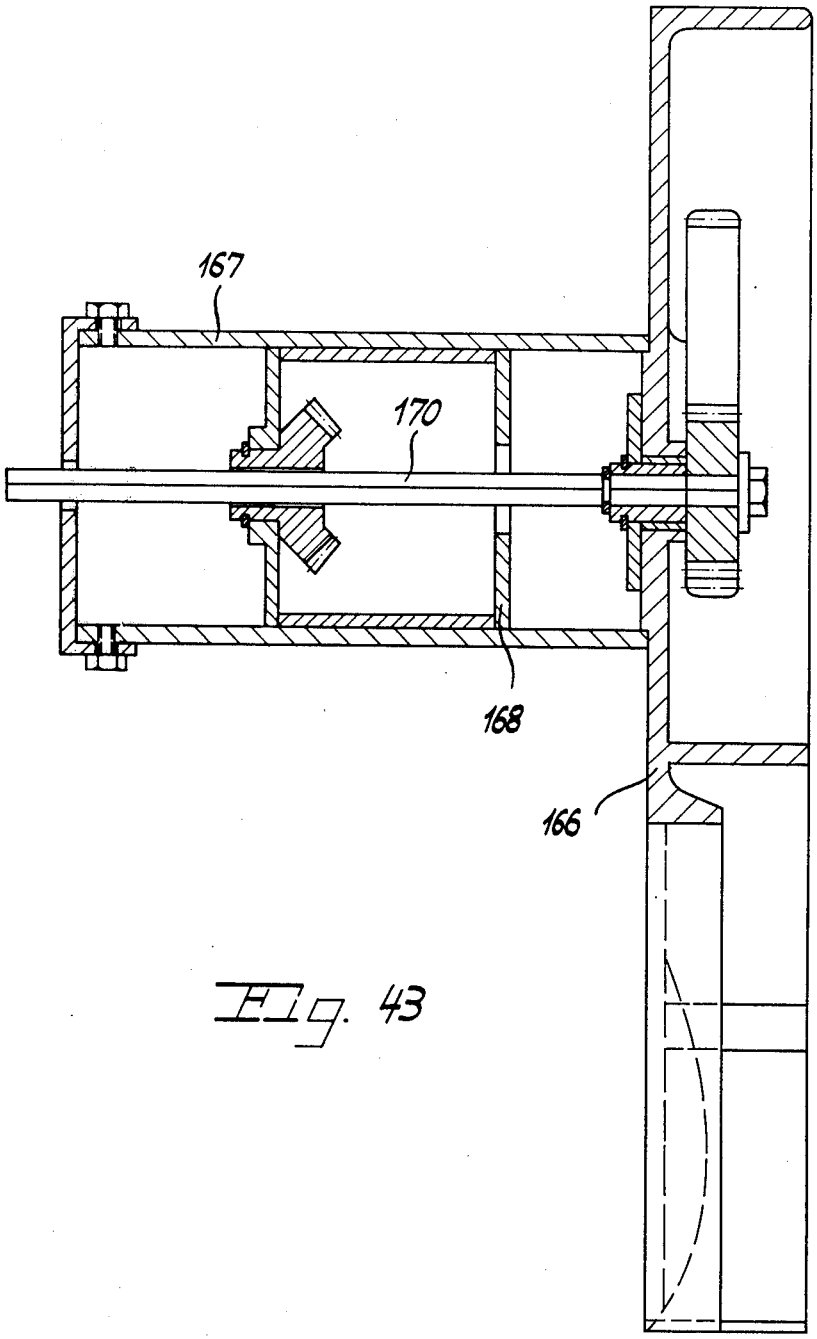

FIG. 43 is a side view, partially in section, of a laterial confining element of a jalousie according to the invention.

Figure 44:
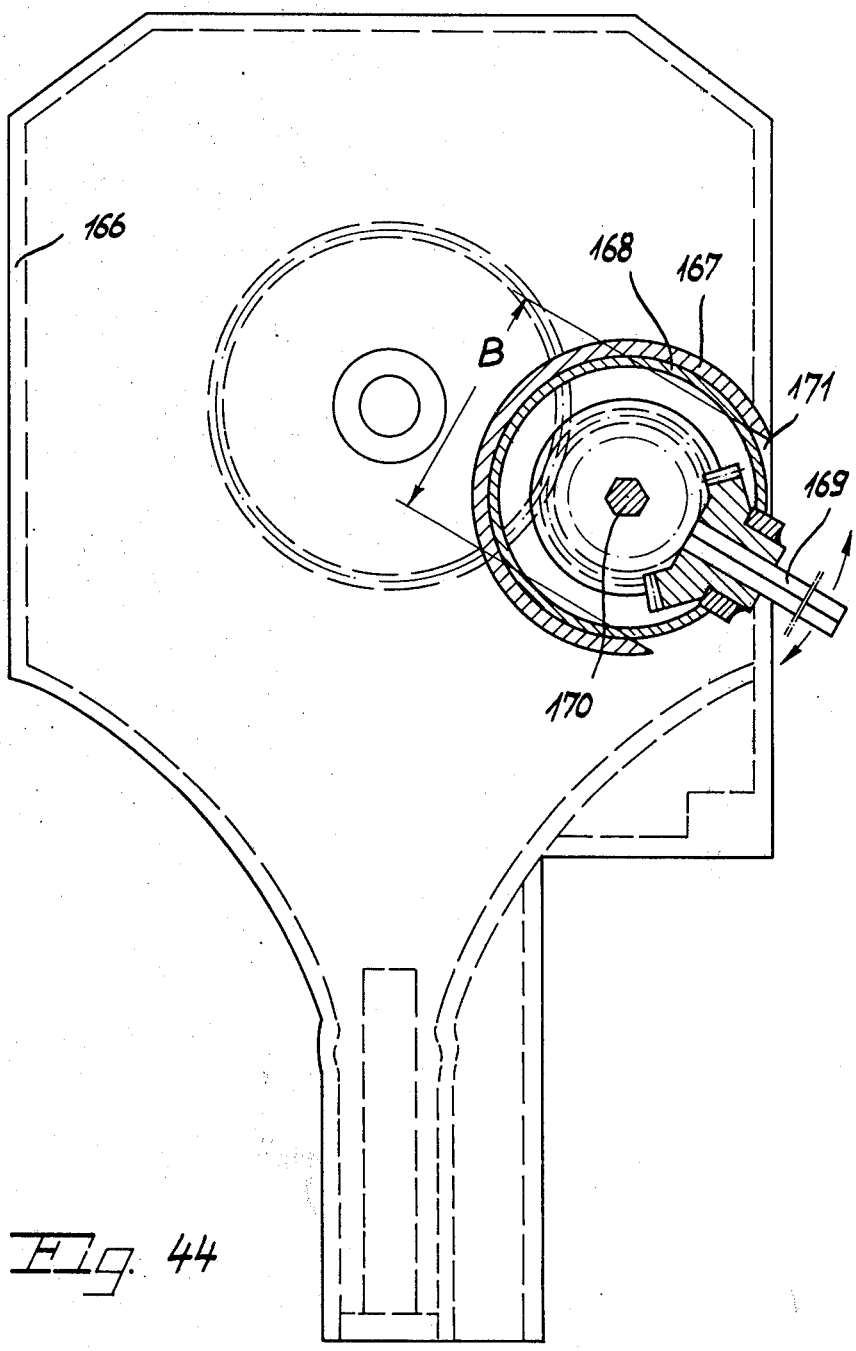

FIG. 44 is a front view of said confining element of FIG. 43.

Figure 45:
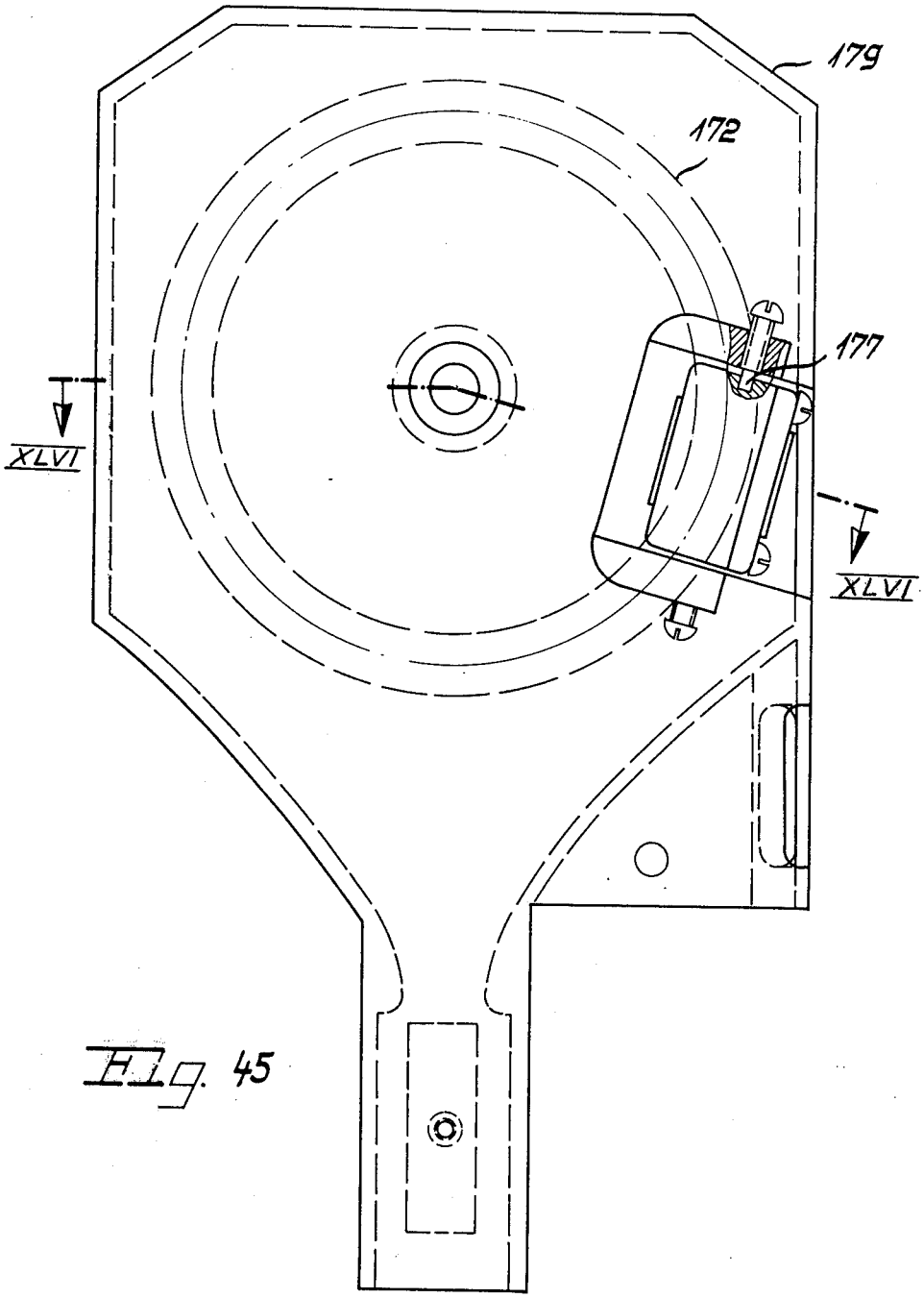

FIG. 45 is a view of a crown wheel housing used in connection with the present invention.

Figure 46:
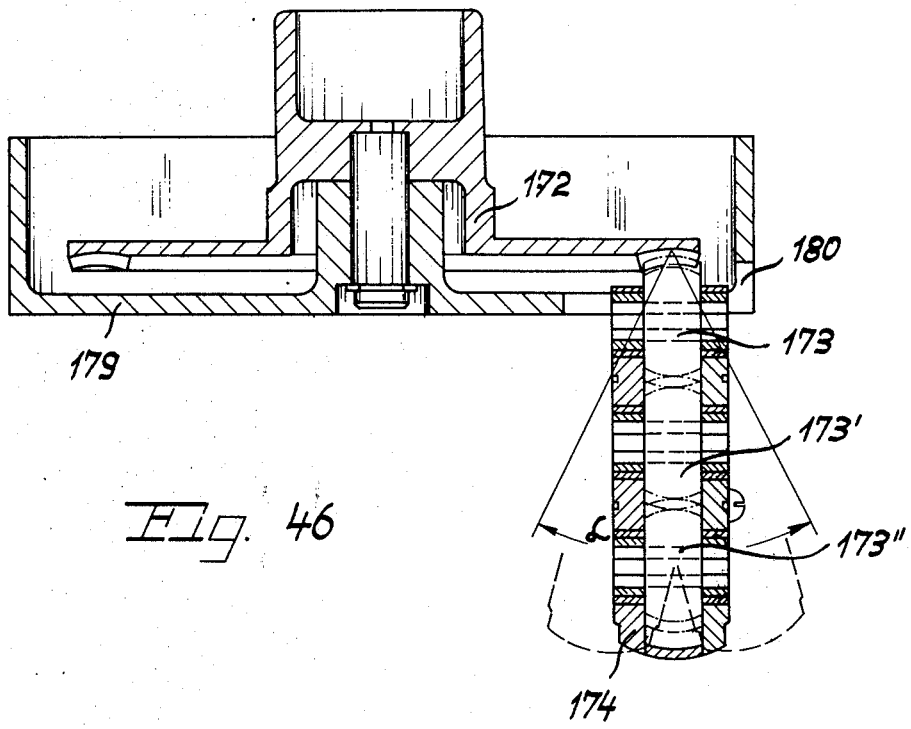

FIG. 46 is a section taken along the line XLVI—XLVI of FIG. 45.

Figure 47:
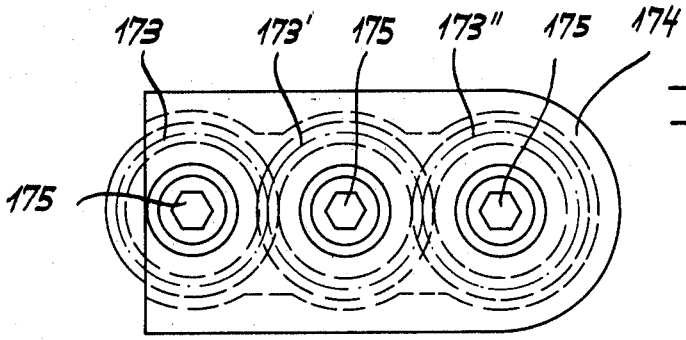

FIG. 47 illustrates a possible embodiment of a drive gear set for the crown wheel.

FIG. 48 shows another embodiment of a drive gear set for the crown wheel.

FIG. 49 represents still another embodiment of a drive gear set for the crown wheel.

FIG. 50 shows the journaling of a drive wheel for the crown wheel in bushings of synthetic material.

FIG. 51 illustrates the journaling of a driving wheel for the crown wheel in an antifriction bearing.

To solve the above outlined object, it is suggested according to the present inventin to prefabricate at the factory the entire jalousie construction, i.e. the jalousie shield or cover, the axle with shaft supporting the jalousie, the lateral guiding rails, the lower angle spacer rail, the actuating elements for actuating the jalousie from the inside, the upper jalousie box with roof and lid and the lateral parts supporting the bearing means for the axle. In order to permit an easy transport for the prefabricated jalousie construction and in order to be able to produce the parts of cast or punched products it is suggested in contrast to heretofore known methods of making jalousie, to employ guiding means, angles and boxes preferably of aluminum or synthetic material, while when employing synthetic material, in particular the side part may be produced of injection molded synthetic material.

The lateral parts of the roller box which are decisive for the jalousie element are in conformity with the present invention made of a unitary cast, molded or punched piece and as far as possible furnish all connecting possibilities for the nut elements without requiring an additional machining. Thus, the bearing means for the jalousie shaft may be inserted into the lateral parts when the latter are cast and similarly the bores for connecting the box roof and the front lid or cover may be provided. Similarly, the bearing portions for the possibly necessary transmission operation may be cast-in, molded-in, or punched-in, and the holding means for the guiding rails may be provided. According to the invention, the guiding means may be inserted with a butt surface into the lateral part inasmuch as a continuation of the two lateral guiding legs in the form of a funnel is involved. For a fast assembly of the jalousie element, a mechanism is cast injected or punched into the laterial part, which mechanism receives a second part in the form of a stud previously connected to the window and locks said second part. In order to assure that the jalousie rail will not protrude too far outwardly, in other words, with a thin soffit will not be located in front of the masonry, but on the other hand, with possible window abutments will guide the jalousie past the same, the lateral part is so designed that it has a central connecting part extending downwardly for guiding purposes. In order to obtain an even plane of the groove bottom, the connecting part of the guiding means has the rear supporting surface of the lateral member within the range of the guiding means reduced by the thickness of the guiding material. In order to make sure that the jalousie element will be completely sealed against rain water in conformity with the differences of the masonry, the end of the box roof will has a small portion bent up, or will have a pressed-in profile synthetic material while the guiding means and the roof will additionally be provided with sealing strips of foam rubber material, or the like.

Figure 1:
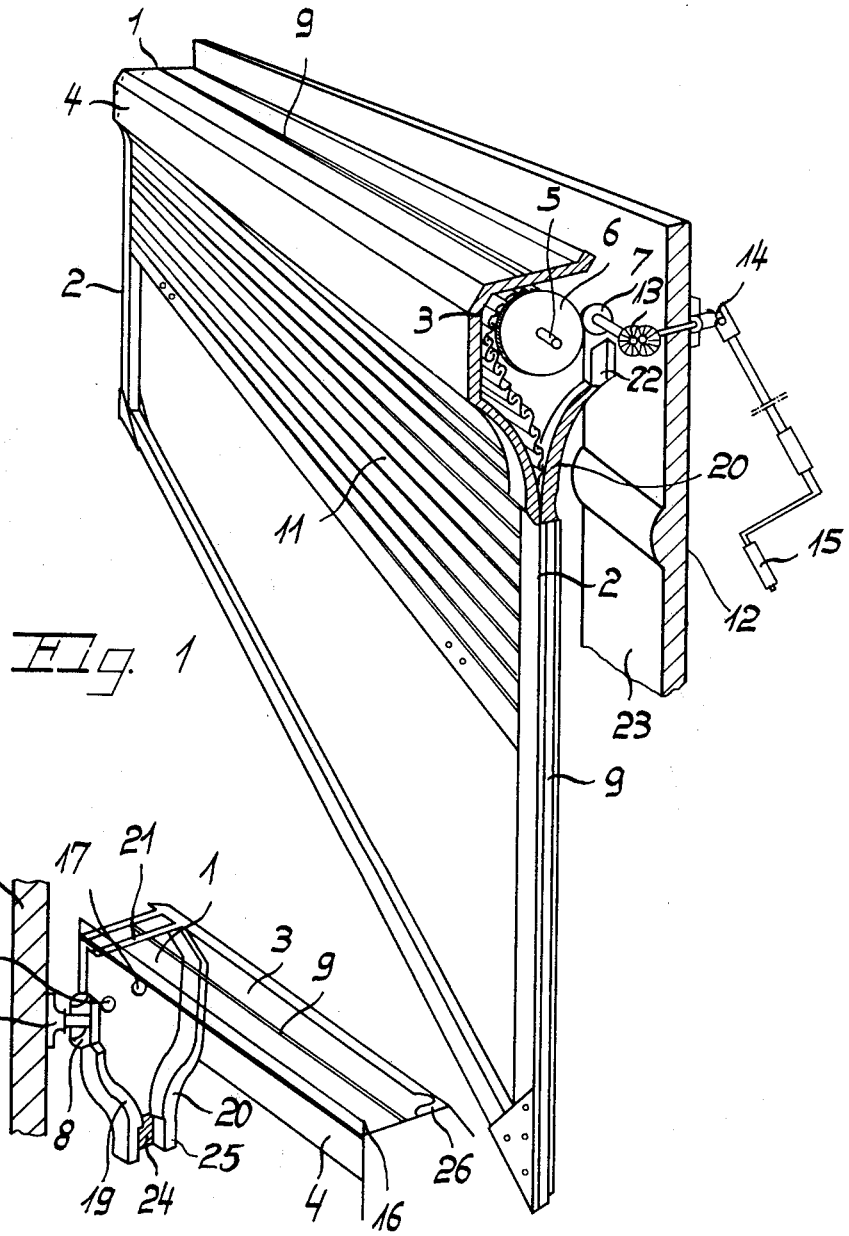
FIG. 1 is a perspective view of the entire jalousie according to the present invention.
Figure 2:
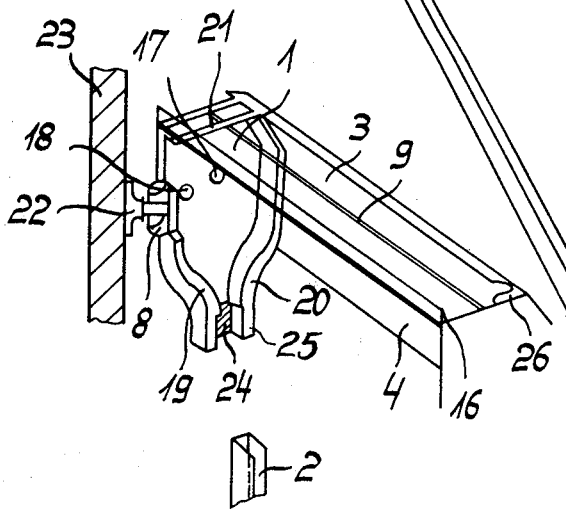
FIG. 2 shows the upper left-hand portion of FIG. 1.

Referring now to the drawings in detail, and FIG. 1 thereof in particular, FIG. 1 shows an overall view of the entire jalousie unit, while FIG. 2 shows a lateral portion of the upper jalousie box. The jalousie unit shown in FIG. 1 is composed primarily of the two lateral members 1. It is into these lateral members that the grooved running rail 2 is inserted and the roof sheet 3 as well as the cover 4 are connected to said lateral parts 1. Furthermore, the shaft axle 5 of the jalousie is journaled in said lateral parts 1 and the actuating and transmission means, for instance, in the form of two spur gears 6 and 7 are connected to said side parts 1 while clip element 8 is cast into or punched into said side parts 1. Mounted on the outside of the grooved rail 2 is a sealing strip 9 which is continued on the box roof 3. The central tapering of the lateral parts 1 permits the jalousie 11 to pass by the abutment 12. The operation is effected through the intervention of a bevel gear drive 13, a ball or cross joint 14 up to the crank 15.

FIG. 2 shows the lateral part 1 with the bearing 17 for the jalousie shaft and a bearing 18 of an actuating mechanism. The two funnel-shaped extensions 19 and 20 of the two guiding legs end on one hand in frame 21 necessary for connecting the cover 4 and roof 3, and on the other hand end in a cast-in or punched-in clip element 8. It is in this clip element 8 that when pressing the jalousie unit against the window frame 23, the previously assembled second part of this connecting element 22 clamps in. In the insert part 25 of the lateral part 1 there is provided a precisely fitting portion 24 for the guiding means 2 all shown in FIG. 2 collectively. An edge 16 bent upwardly at the end of the box roof 3 prevents the water from entering. For the same purpose there is provided a pressed-in profile or profiled synthetic member 26 as well as the sealing strips 9 on the guiding means 2 and on the box roof 3. The jalousie slat system may also be operated by means of a strap. Inasmuch as the strap is an element without resistance, no danger exists that the jalousie slat system once let down completely will be displaced by the strap in the reverse direction. Such a danger exists with drives which are firmly connected to the jalousie shaft, as is not the case with a flexible strap. Such drives are electro-drives or crank-driven drives. Electric motors have an automatic limit swithc for switching off the jalousie motor as soon as the jalousie slat system has reached its lower end point. Jalousies which are operated by a crank drive do not have their lower end point equipped with a turn-off mechanism so that the danger exists that the operator winds the jalousie in a reverse or wrong direction. According to a further embodiment of the invention, a brake is provided for the finer turning off or disengagement of the jalousie winding mechanism. This brake is assembled on or adjacent to the jalousie shaft. The axle of the jalousie shaft is provided with a thread and is extended while the jalousie shaft is, to the same extent, reduced. Directly adjacent or above the axle of the jalousie shaft there is provided a cast-in or mounted abutment web, and three nuts engage the axle which on one hand is located in the jalousie shaft and on the other hand is located in the lateral member or the bearing cup for the jalousie housing or the masonry. One nut is provided with a cam for abutment against the abutment web so that the nut can be turned only by half a revolution. When further turning the jalousie shaft, the said abutment nut moves along the abutment web on the axle provided with thread. Two further nuts are firmly screwed to each other to such an extent that they form an abutment for the moving cam nut. These nuts are adjustable in conformity with the height of the jalousie. Instead of two nuts, also a small arresting screw may be employed inasmuch as the two nuts are so small or the abutment web is spaced from the axle to such an extent that they can move below the web. In order not to increase the load on the abutment web, preferably a left thread is selected. The roller brake to be employed in conformity with the inventin for the jalousie slat system will now be described in connection with FIG. 3.

Figure 3:
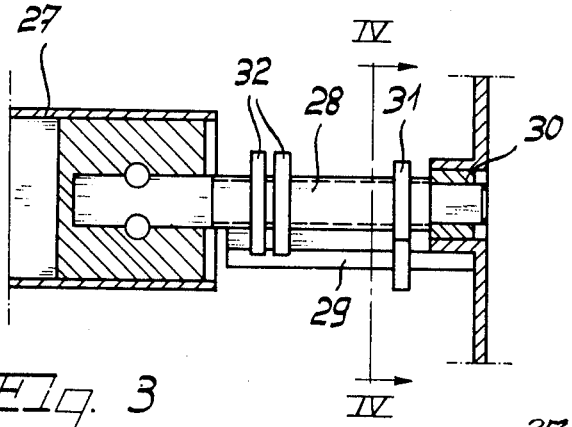
FIG. 3 shows a section through the jalousie shaft with the shaft axle.
Figure 4:
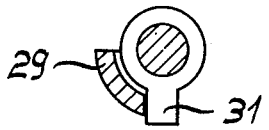
FIG. 4 shows a section through an abutment member with an abutment nut, said section being taken along the line IV—IV of FIG. 3.

FIG. 3 shows the jalousie shaft 27 with the shaft axle 28, the abutment web 29, the bearing 30 of the shaft axle, the cam nut 31 and the two abutment nuts 32. FIG. 4 shows a section through the abutment web 29 with the cam nut 31.

The jalousie slat system, as a rule, has a so-called end slat for providing a stable lower closure of the slat system and furthermore to increase the drop weight of said slat system. The jalousie end strip employed with the jalousie unit according to the invention is furthermore intended precisely to fix the end positon of the jalousie when the slat system thereof is wound up. Therefore, it is suggested according to the present invention that this jalousie end strip has a fixed closure angle which is fixedly connected to said jalousie end strip and extends all the way through. This closure angle takes over the function of heretofore used individual angles which are rather awkward to be connected to the remainder of the slats. Moreover, this closure angle imparts a considerably greater stability to the last slat.

The lower slat is furthermore provided at its lower end with a slight rounding so that it can favorably enter the grooved member. Inasumch as the last slat cannot only be made of synthetic material, but may be made of extrusion pressed aluminum, and in view of the higher molding costs should not form a hollow body, said last slat will have its back side provided with an opening extending through said last slat. The two ends of said opening are somewhat angled off so that a pin can be inserted for obtaining a safety positon. This construction of the jalousie slat is shown in FIGS. 5, 6 and 7. FIG. 5 shows a section through the jalousie slat 33 with a lower angle 34 and with the inner rounding 35 and the opening 36. FIG. 6 shows the connecting hook 37 for the next slat of the slat system 38. FIG. 7 illustrates that the angle 34 is arranged in the central portion of the last strip 33.

The jalousie slat system has its slats laterally guided in suitable guiding grooves or guiding rails. These rails are, in most instances, connected to window frames of wood or metal. Particularly when the jalousie is later mounted on the window, then at the time of building the respective buidling, it may sometimes be possible to connect the guiding rail not directly to the window frame, but in the window soffit on the masonry. Inasmuch as the masonry is frequently rather uneven, it is necessary to seal this rail with the plaster or the bricks. To this end, the groove may be sealed with foam material or rubber strips, or the cavities may be filled with putty, caulking, or the like.

The present invention furthermore provides a jalousie guiding rail having an eye or opening on the bottom of the groove of the rail. This opening is so designed, preferably even provided from the very start in the extrusion pressed profile that a sealing mass or the connecting members thereof can frictionally be inserted into the opening. As sealing mass rubber and synthetic strips with a bead along one side has proved particularly advantages. The bead has a diameter greater than the diameter of the strip and is inserted into the opening. This solution has the advantage that the rail and the sealing mass will be positively connected to each other. The sealing strip is selected of such soft material that it will likewise in a positive manner adapt itself to the shape of the breaks or plaster, or the like. FIG. 8 shows the rail 39 with the groove bottom 40 and the opening 41. FIG. 9 shows the sealing mass in the form of a strip 42 with the bead 43 which is inserted into the opening 41. FIG. 10 shows the rail 39 with the opening 41 laterally of the groove bottom.

As mentioned above, the jalousie unit according to the present invention may also later be mounted in front of the windows of a housing. These jalousies mounted from the outside have the great disadvantage that either they cut out a lot of light, or they are difficult to mount. In the first instance, the slat system is mounted against the window frame, in other words, in the soffit. Since, however, the diameter of a rolled-up slat system of wood is about 20 centimeters, approximately 15 cm light is lost over the entire width of the window when disregarding the window frame itself. When the jalousie box is mounted on the outside of the masonry, no light is lost, but in this instance, it is necessary to pass the device for actuating the jalousie from the inside through the wall. Since, however, as a rule a cast concrete lintel is located above the window, such passing through of the device for actuating the jalousie can be effected only at considerable cost and at the expense of considerable time. For this reason, outer jalousies are, as a rule, mounted deeper into the soffit of the window while the loss in light is put up with.

The drawbacks of the outside jalousie are avoided according to the present invention by the fact that the driving shaft of the jalousie made in a manner known per se, of light metal carries a worm wheel meshing with a worm. This worm is journaled perpendicularly to the drive shaft in the jalousie box composed of a rectangularly bent sheet with rectangular lateral closure members. The extended shaft of said worm is passed through a bore in the window frame on the inside of which the shaft is coupled to a driving means in a positive or frictional manner.

Inasmuch as the new light metal jalousie has a very thin wall thickness, which when applied to ordinary windows in wound-up condition, does not exceed 10 centimeters, the roller box can, in conformity with the invention, be reduced by one-half, and the loss in light will no longer amount to 15, but will as a maximum amount to 5 centimeters. In view of the light weight of the jalousie made of light sheet metal having a thickness of approximately 0.5 millimeters, also the operation is greatly simplified and no longer requires the power it does with heretofore known wooden jalousies. According to the present invention, a worm drive of very small dimensions may be selected while for purposes of passing through the extended worm shaft, only a bore of approximately 8 millimeters diameter will be necessary for passing the worm shaft for a thickness of from 5 to 6 millimeters through the window frame. Consequently, the heretofore necessary relatively wide slot for passing the strap through, which was required with heretofore known wooden jalousies and which slot considerably weakened the window frame will be completely superfluous. This thin shaft may on the inside of the window in any convenient manner be coupled to a driving means in a frictional or positive manner. In conformity with the invention, to this end, a strap roller or a cable drum may be mounted on the shaft end while the driving rope or cable is wound around said roller or drum. This driving cable is expediently selected endless so that the cable drum may be moved in both directions in view of the self-locking property of the worm drive.

Instead of a cable drum with cable or rope, it is possible according to the invention to provide a crank rod in corresponding holding means on the inside of the window, the said holding means communicating with the worm shaft through ball joints. The jalousie shaft and advantageously also the worm shaft are both journaled in antifriction bearings which are mounted on the side walls of the jalousie box or on the end wall thereof.

In order to be able as the case may be by means of the jalousie to obtain a complete darkening of the window against entering light, it is suggested in conformity with a further development of the invention to upholseter the lateral U-shaped guiding grooves in which the jalousie slides, with foam material while at the back side of the guiding means a strip of darkening material is provided.

The above special jalousie construction will now be briefly described. FIG. 11 shows a front view of the jalousie with the end face sheet removed and also shows a longitudinal section through the antifriction bearing. FIG. 12 shows a cross section through a jalousie with pulley drive while FIG. 13 represents a cross section through a jalousie with crank drive, and FIG. 14 shows a cross section through various guiding means of the jalousie. FIG. 15 finally shows a partial section through the jalousie.

The jalousie 45 composed of thin light metal bars 44 has its axle 46 journalled in ball bearings 47 which are connected to the lateral sheets 48. The jalousie axle at one side thereof carries a worm wheel 49 which meshes with a worm 50. Worm 50 has its extended shaft journaled in bearings which may either be slide bearings 51 or may be formed by antifriction bearings such as ball bearings. One of said bearings is connected to the front wall 53 of the jalousie box whereas the other bearing is connected to the window frame 54. The worm shaft 55 extends on that side which faces the window and passes through a bore 56 in the window frame so that it comes out on the inside of the window. Connected to the truncated shaft, according to FIG. 12, is a cable or strap pulley 57 with an endless cable 57*a* while, according to the embodiment of FIG. 13, a joint shaft 58 is connected which is connected to a crank rod 61 journaled in holding means 59, 60 on the window frame. The lateral U-shaped guiding means 62 for the jalousie box is connected to the window frame by means of screws 63. On the outside of the U-shaped guiding means there are provided foam rubber cushions 64 for sealing the jalousie against the passage of light. The same purpose serves a strip 65 of darkeing or blackout material.

The jalousie unit according to the present invention is equipped with special structures for driving the jalousie slat unit as is necessary when pulling up or letting down the slats. In addition to the ordinary operation of all slats by means of a pull strap, various other driving possibilities exist. These various possibilities or designs are connected at that portion of the jalousie shaft where otherwise the strap pulley is located.

Preferably, however, difficulties are encountered with the jalousies for old windows, in other words, with houses in which jalousies have not been installed during the building of the house. The operating member must not be passed through the window wing. Window frames, however, have different dimensions in many old houses or buildings. This fact represents an almost unsurmountable difficulty. The drive according to the present invention for the jalousie unit is based on the idea to make the tranmission laterally displaceable so that it will never have to be passed through the window wing, and never through the lateral masonry of the wall soffit. It should be displaceable in such a way that the transmission or the operating element can be well guided through the window frame. According to the design of the present invention, the axle of the jalousie shaft can be extended considerably. This axle would simultaneously represent the axle of a small transmission. This transmission may be a ball wheel transmission, a bevel gear transmission, a helical gear transmission, or a worm wheel transmission. In this connection it is merely important that each of these transmissions comprises two windows and two soffits. The first and main shaft would, as mentioned above, simultaneously represent the shaft of the jalousie axle. Inasmuch as this shaft is extended, the transmission could be made displaceable.

A certain possible design consists in that the axle of the jalousie shaft is provided with a hexagonal or square hole. Similarly, the main axle of the small ball wheel transmission, bevel gear transmission, helical gear transmission, or worm wheel transmission may be provided with a corresponding same hole, and a hexagon could over the corresponding length establish the connection between the axle of the length of the jalousie and the axle of the small transmission. Furthermore, the connecting shaft could be correspondingly extended or shortened so that also the displaceable purpose of the small transmission would be realized. According to the third design possibility, the main shaft of the small transmission, as mentioned above, may be kept very long. The axle of the jalousie shaft is likewise provided with a bore which corresponds to the axle of the small transmission. Thus, the small transmission or its axle could be introduced into the axle of the jalousie shaft and again the small transmission may be displaceable.

FIG. 16 shows the jalousie shaft 66 with its axle 67. The small transmission 68 has two bevel gears 69 and 70. The axle for this small transmission 68 is formed by the axle 67 and the axle 71. The main axle 67 simultaneously forms the axle of the jalousie shaft 66. It is journaled in a bearing 72 in the lateral part of the jalousie box 73.

FIG. 17 again shows the jalousie shaft 66 with its axle 67′ having a bore. Similarly, the axle 74 of the bevel gear 70 is provided with a bore. The connecting shaft 75 can correspondingly be introduced, shortened, or extended.

Figure 18:
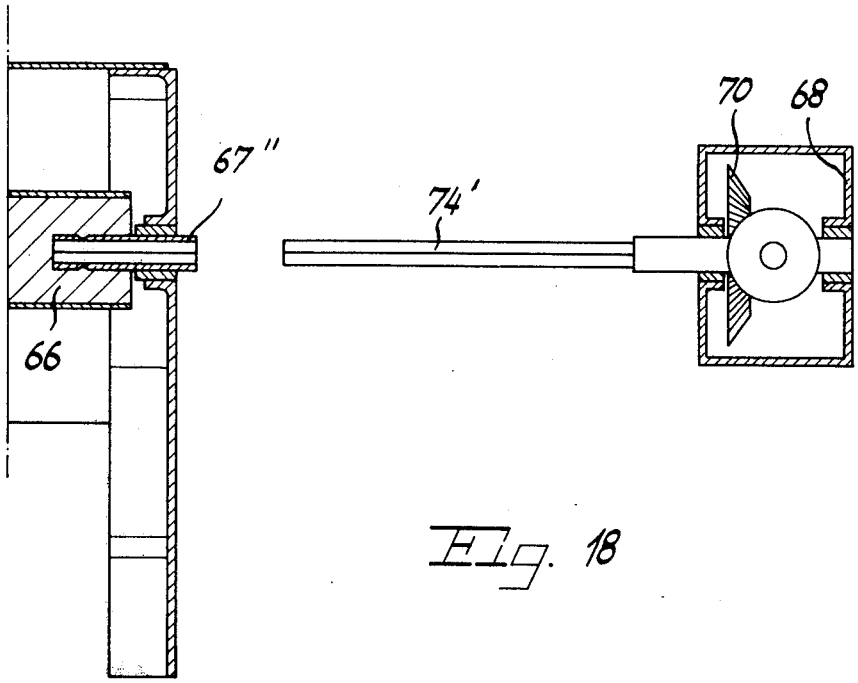

FIG. 18 shows the jalousie shaft 66 with its axle 67″ which, however, in this instance is bored all the way through. The small transmission 68 has a large bevel gear 70 with an axle 74′ which is fixedly connected thereto and which is extended to a considerable extent. The axle 74′ can be introduced into the axle of the jalousie axle 67 of the jalousie shaft 66.

With the jalousie unit according to the present invention, whose jalousie boxes, bearings, guiding means, spacer rails, etc. is in a factory finished to a complete structural unit, the actuating member for such unit represent the decisive factor. In the following description of further features of the present invention primarily actuating and operating guiding means are involved as they are required for these jalousies, especially for the upward and downward movement thereof and for the braking effect. The heretofore employed operating possibilities are, on one hand, the movement by ordinary pull straps which are held by means of a clamping mechanism. Furthermore, the operation through a planetary gear transmission or bevel gear transmission with brake mechanism built in from the start, or the operation with electro-motor drives.

Especially with outside jalousies, these operating possibilties, especially when it is desired to operate the jalousie from the interior of a room are rather complicated, inasmuch as they are rather big, and in most instances are not laterally displaceable unless the shaft can be extended. With later installed jalousies it is, however, decisive that the lateral guiding rails be kept as narrow as possible and that the front edges of the upper masonry will not be damaged when assembling the jalousie while the operation and the passage inwardly should not occur through the window wing, but through the window frame.

Various window types developed over half a century may be equipped with the same outside jalousie and the operation from the interior of a room must adapt itself to the requirements. For this reason, the operating possibility and the passage through the window must be selectable, variable, and adjustable, and in conformity with the requirements. The invention therefore provides that the outwardly mounted jalousie may be operated from the inside by an endless cord or a crank rod. When operation with a cord is desired, a lining of the guiding rail and a boring through of the window wing should be avoided. In conformity with the invention, 2 millimeters thin spur gears are mounted in the lateral part which defines the roller box, which spur gears permit an exit at the edge of the lateral part. The bore to be drilled in the masonry for this purpose along the frame may be kept so small that the front plaster edge of the soffit will be retained.

The outwardly protruding shaft of the second spur wheel ends displaceable in a worm wheel which meshes with a worm shaft which is displaceably mounted on the shaft of the pulley wheel. The two shafts are made of semi-round, hexagonal or similar shapes of shafts. The worm wheel and the worm shaft are provided with corresponding passages and are journaled in a small housing. The axle of the worm shaft extends through the frame and ends in a covered pulley which is connected on the inside to the window frame.

If it is desired to avoid this additional transmission, the two adjusting cord strands may also be passed through the upper frame and from th latter toward the outside where they run over a similar small grooved pulley, the axle of which, likewise carries the first small spur wheel in the side part and will, when subjected to a pulling load due to a support retain a uniform distance from the window. In order to press the cord into said grooved pulley, rollers or pressure wheels are provided above or in front of said pulley. The said pulley and the support are again displaceable laterally on the axle. The now lacking braking effect is brought about in a manner known per se in the interior of the room at one of the two cord strands.

When employing a connecting rod, it is advantageous to use a double cross or ball joint, the central connection of which is effected by an extended axle in conformity with the requirements. In this way, a lateral difference of the two joints can be compensated for. The first ball joint which is located directly on the shaft of the small spur wheel has guiding means in the second part, which guiding means sees to it that the degree of efficiency of the joint is not exceeded or that the degree of efficiency of the joint does not drop below a desired value.

In the second part of the second joint mounted inside on the window frame, there ends the pipe of the connecting rod which, when the joint hangs vertically and is simultaneously angled by 90°, puts the said joint out of operation and thus realizes the braking effect for the jalousie or blind.

If greater distances had to be bridged, according to the invention flexible shafts are employed which on one hand end in the axle of the second spur gear and on the other hand end on the ball joint inside on the window frame. If no difficulties are encountered to laterally open up the masonry, one end of the flexible shaft may end immediately into the axle of the jalousie shaft.

If, however greater distances are to be bridged, it is suggested as with the cord embodiment, to carry out the angle arrangement with two axles crossing over each other while, however, in view of the braking effect of the employed connecting rod with cross or ball joint or the like, no self-locking worm gear transmission must be employed, but a bevel or helical wheel set mounted in a small housing is to be employed and is to be laterally displaceable on both shafts.

If the window frame is not to be set against a fixed abutment but a wall without abutment is to be made, the output is laterally placed into the masonry to a lesser extent, inasmuch as the introduction of the output shaft is not affected by the window frame. According to the present invention it is suggested in the side part of the box to mount a bevel gear helical transmission, the transmission wheels of which, are connected to the axle of the jalousie shaft and the driving wheels of which have straight axles extending through the frame.

If costs have to be saved, the least expensive design would be in the form of a large grooved pulley which is connected to the axle and which is driven by an endless cord. In order to protect the jalousie prior to the unwinding, a grooved pulley with diagonally extending mounting of the axle is connected to the side part of the box. Said axle reduces the passing of one cord strand when lifting or lowering the same and thus permits a braking effect. The braking roller may also be connected on the inside on the window frame or may be replaced by a combination spring in the shaft of the jalousie. Expediently, the low transmissions are, in view of the possible entering of soil, built into housings which simultaneously offer the possibility of providing bearings for the axles of the drives. The design provides in conformity with the invention to make the spur gears, helical worm gears, bevel gears, and roller gears, one piece with the shaft while providing these elements with hexagonal semi-circular or similar bores and correspondingly designing the connecting axles to be introduced, so that they will be freely axially displaceable.

In order to avoid the sometimes complicated arrangement of the small drives and transmissions in the masonry, the small worm drive may directly be connected to the engaging cord pulley on the inner window frame. This would be suitable with concrete-like masonry or marble conduits. FIGS. 19 to 29 illustrate corresponding constructions, and more specifically FIG. 19 shows a section in top view with cord transmission worm wheel transmission and spur gear transmission. FIG. 20 shows a section in top view with cord transmission and spur gear transmission. FIG. 21 shows a section in top view with a double cross joint and spur gear transmission. FIG. 22 is a section in top view with flexible shafts. FIG. 23 is a section in top view with helical wheel and spur gear transmission. FIG. 24 is a section in top view with a large bevel gear transmission. FIG. 25 is a section in top view with a small bevel gear transmission. FIG. 26 shows a section in top view with large helical wheel transmission. FIG. 27 shows a section in top view with a transmission located inside the room. FIG. 28 is a view of the side parts with a large cord pulley and clamping device.

Going back to FIG. 19, this figure shows an operating suggestion according to which the axle 76 of the small spur gear extends through a worm wheel 79. The displaceable second axle 80 of the small cord pulley 81 extends through the worm shaft 82. Housing 83 extends around the worm wheel drive.

FIG. 20 shows the cord 84 passing through the window frame 85 and turning a small cord pulley 81 connected in front of the frame 85. The axle **76*a* of roller 81 at the same time forms the axle of the small gear 77. A support 86 maintains the spacing with regard to the window frame 85**.

FIG. 21 shows two ball-cross joints 87 and 88, the central axle 89 of which, may be extended depending on the thickness of the frame. The upper cross joint 87 is directly connected to the axle **76*b* of the small spur gear 77**.

FIG. 22 illustrates that instead of the cross joint, also flexible shafts 90 and 91 may be employed which end on one hand in the axle **76*c* of the small spur gear 77 and on the other hand end directly in the jalousie shaft 92. At the other end of both shafts 90 and 91, and in front of the window frame 85 in the interior of the room there is again provided a ball or cross joint 88. FIG. 23 illuatrates how instead of the worm wheels 79 and 82 illustrated in FIG. 11, helical wheels 93 and 94 may be journaled in a housing 83. Also in this instance, the axles 76*a* and 80 may be displaceable toward both sides, inasmuch as they are only semicircular, hexagonal, or the like, while the helical wheels equal bores. FIG. 24 shows that instead of the large spur gear (see FIGS. 19 and 21), the axle of the jalousie shaft 92 has connected thereto a large bevel gear 95. A small bevel gear 96 meshes at an angle with the large bevel gear and is mounted on shaft 80 which penetrates the frame 85**.

FIG. 25 illustrates how, instead of the helical transmission referred to in FIG. 23, a small bevel gear transmission 97 with and axle **76*e* is centrally connected in the small bevel gear, the other axle 80 of which penetrates the window frame 85**.

FIG. 26 shows that instead of the bevel gear according to FIG. 24 also a helical gear transmission comrpising a large helical wheel 98, is immediately connected to the shaft axle 91 and to a small helical wheel 99, the shaft 80 of which penetrates the window frame 85.

FIG. 27 illustrates a worm wheel drive similar to that of FIG. 19. However, in this instance, the worm wheel drive is in front of the window frame 85 connected in the interior of the room, said worm wheel transmission comprising a worm wheel 79 and a worm shaft 82, a very short axle 100, and the cord pulley 81.

FIG. 28 illustrates the side part 101 with a large cord 102 connected directly to the roller axle **92*a*. The upper cord reach 103 passes through a pre-fabricated passage 104 in the side part 101. In view of its diagonal axle bearing 106, the cord reach 103 is clamped in during the upward and downward movement. FIG. 29 shows the clamping mechanism 105** in the form of a guiding means which tapers during the movement of the reach, said guiding means being located in the loose element as it may be placed in front of the window frame.

For driving the jalousie, driving elements are employed according to which the power input is, as a rule, located outside a side part, while the introduced force is conveyed to the jalousie shaft through the intervention of transmission elements which are likewise located partially outside the lateral part. To this end, in addition to the side part thereof necessary additional housings are mounted on the outside of said lateral part for receiving the transmission elements. In view of the different installing conditions, it must be assured that an adaptation of the power input, in axial direction of the shaft of the jalousie as well as in a certain angular position thereto will be possible. In order to meet these requirements, the driving devices have to be arranged in separate housings which driving devices, in their turn, must be displaceable in these housings and must be pivotably mounted therein. In addition thereto, the transmission elements located in the power input range have to be connected with the transmission elements on the jalousie shaft through an intermediate shaft. The heretofore known constructions are thus, in view of the problems to be met, rather complicated in construction. In particular, a multiple number of individual units is necessary, which number will complicate the assembly and also will increase the costs. According to a further development of the invention, it is suggested that the transmission element fixedly connected to the jalousie shaft will have its shafts provided with a cylindrical extension having a groove on the outside into which the wall of the jalousie semi-shaft may be pressed. Furthermore, the invention provides that the shaft carrying one transmission element is journalled in a support forming a unit with the housing. The advantage of such a design consists in that in view of the employment of a few individual elements, a particularly simple construction will be obtained, inasmuch as also the difficulties encountered during the assembly are reduced to a minimum. Furthermore, the simple construction also represents a considerable advantage as to costs. This particular construction according to the invention is illustrated in FIS. 30, 31, and will be subsequently described. FIG. 30 illustrates in section a front view of a jalousie driving device according to the invention. FIG. 31 is a top view in section. FIG. 32 is a side view partially in section.

The lateral part 107 is, within the range of the mounting area 108, formed so as to define an outwardly extending closed chamber 109 which is open toward the inside. In the chamber 109 there is inserted a worm wheel drive 125 which is located in a separate housing 110 and which is driven from the outsdie through the intervention of a flexible shaft 121. Fixedly connected to the worm wheel drive 125 is an intermediate shaft 112 which, through an opening 113 provided in housing 110, is passed into the jalousie inner chamber 114.

The free end of shaft 112 carries a pinion 115 which cooperates with a pinion 116 which, in its turn, is mounted on a shaft 117 journaled in a support 126 extending outside the housing 110. The extension of shaft 117 is formed by a cylindrical extension member 118, the outer diameter of which, corresponds to the inner diameter of jalousie shaft 119. Shaft 119 is hollow and preferably is made of metal. However, there also exists the possibility to make shaft 119 of synthetic material. In order to assure that the rotary movement conveyed by the worm to the gears 115 and 116 will be continued to the jalousie shaft 119, the extension member 118 of shaft 117 has its circumference provided with a groove 120 into which is pressed the outer wall of the hollow jalousie shaft. This pressure is so high that a relative movement between the extension member 118 and shaft 119 will not be possible. Connected to the elastic shaft 111 is a drive shaft 121 in a manner known per se. The elastic shaft 111 is, on one hand journaled the power input 122, and on the other hand in the side part 123 of the window blind frame. Inasmmuch as the bore 124 extending through the side part 123 of the window blind frame can be provided later, an easy adaptation in connection with the flexible shaft 111 to the respective power output 122 is easily possible.

Also, with primarily light jalousies which are mounted from the outside in front of the masonry, a mechanical drive for lifting, lowering, and braking the jalousies shield is expedient. The heretofore employed driving mechanisms for jalousies are straps. The operation of straps is ideal for the mounting of the jalousies on the inside. However, if the jalousie has to be mounted from the outside, the passage of the straps through windows and masonry is complicated. For this reason it becomes necessary to drill a thin slot or narrow hole through the masonry or the window frame so that in the first place not much will be destroyed or disturbed and in the second place the necessary work will be relatively little. The jalousie drive is, therefore, so designed that its operation is effected with an angled crank which, on one hand does not require a box to be inserted into the wall as is the case with strap winding means, and on the other hand requires only a thin metallic pin for establishing the connection to the jalousie toward the outside.

According to a further development of the invention, it is desired to convert the turning movement of said steel or metal pin extending through the window frame or masonry into an upward and downward movement of the jalousie. This is possible in conformity with the present invention by the employment of a crown gear. The crown gear of the transmission according to the present invention is rather narrow, approximately 6 millimeters thick including the teeth and is mounted very close to the housing wall of the transmission. In this way, not much space is required for the large transmission wheel, and the width of the groove of the jalousie can be kept within normal dimensions. Since, however, with the various old buildings the cost and location for the windows in the masonry vary and also different widths of the window frame exists, a solution had to be found to selectively displace the pin or metal pin extending through the frame of the masonry. This problem has been solved by a crown wheel with concavely curved teeth meshing with a small drive wheel having convexly curved teeth. In view of the shape of the teeth, the small driving wheel can be displaced toward the left or toward the right and can be adjusted in conformity with the requirements in such a way that the break through for the window or the masonry can be effected at a most favorable place. Expediently, all these parts are cast, may it be the housing of the transmission which simultaneously represents the housing of the jalousie box, or may it be the crown wheel, the driving wheel, and the housing and journaling of the small driving wheel. Thus, with the crown wheel, the mounting of the shaft of the jalousie can be cast in from the start and will thus take care of two functions, namely, that the jalousie shaft is journaled and that the transmission fits precisely. In conformity with expediency, the small driving wheel is equipped with a hexagonal plate into which the metallic pin extending through the masonry of the window frame may be plugged after the outer elements have been assembled, so that a further connection at the different assembly angle will no longer be necessary. Furthermore, the driving wheel is running in a perlon bushing which, in its turn, is pressed into a bearing precisely designed as to shape for rotatable employment. The journaling of the small driving wheel is so effected that it is journaled in the housing shield of the small driving wheel and can selectively be honed together with the small driving wheel.

The small driving wheel with its housings and bearings is at a somewhat downwardly declined angle so that the operation by the crank will be facilitated. On the inside on the window frame there is screwed a guiding means fitting with the metallic pin passing therethrough. This guiding means comprises two individual elements in the form of bearing cups and as guiding element employs a ball which can be adjusted in conformity with the angling off of the pin. Between the metal pin passing through the window frame on masonry, and the crank, there is provided a cross or ball joint which in view of the slight inclination of the small driving wheel will already at a slight lifting of the bent crank become operative and which on the other hand when lowering the crank acts as brake because at a certain angle, the crossed ball joint does no longer turn.

FIGS. 33, 34, and 35 illustrate various embodiments. In FIG. 33, the housing for the transmission is designated with the reference numeral 127. At the same time, bearing cups of the jalousie box are shown. FIG. 33 furthermore shows the cast crown wheel 128, the small driving wheel 129, hexagonal hole 130 in the driving wheel, the axle 131 of the bearing form, the small driving wheel, the concavely curved teeth of the crown wheel 128, the convexly curved teeth of the small driving wheel 129. The housing of the small driving wheel is designated with the reference numeral 135. The bearing means or guiding bushing 132 with its pressed-in perlon bushing 136 for the small drive wheel 129 will turn in view of its axle 131 together with the small drive wheel 129 and its crowned teeth 134 in the arced teeth 133 of the crown wheel 128. A further perlon bushing is pressed into the housing 127, in which the axle 137 cast into the large crown wheel 128 is journaled. FIG. 34 shows a section through the jalousie box 139. As will be evident from FIG. 34, the hexagonal shaft 140 which is inserted into the hexagonal bore 130 of the small driving wheel 129 is journaled at a slight downwardly directed angle. In this way, the operation with the crank rod 141 is considerably facilitated. At the end of the hexagonal shaft 140 there is connected a ball or cross joint 142 which by holding crank rod 141 in vertical position is put out of operation so that the jalousie will be braked.

FIG. 35 shows the driving shaft 140 extending through the window frame driving shaft 140 which may be provided with a hexagon head or hexagon section that may be mounted in the ball 143. This ball 143 which is preferably made of perlon is, in its turn, journaled in two cast bowls 144 and 145 which firmly engage each other and are held together by window connecting screws extending through the bores 144.

With jalousie constructions, regardless of whether they are used in new buildings being put up or are to be installed in already existing older buildings, the jalousie roller is at both sides journaled in the so-called side parts. Generally, the drive for the jalousie roller is mounted in one side part. The drive comprises a larger gear mounted on the jalousie roller and furthermore comprises a smaller pinion which is driven by a furhter drive means arranged outside said side part and preferably of the self-locking type. This drive means outside the side part is mounted in an independent housing which forms a unit together with side part. This drive means is stationarily arranged, when viewed in axial direction of the jalousie roller or parallel thereto. The stationary arrangement of said driving means in one side part for journaling the roller of a jalousie has the drawback, however, that the power input which is always located on said driving means outside the side part is stationary which fact may cause assembly difficulties when mounting the jalousie in already existing buildings. In addition thereto, the housing cast onto the side part requires additional material which naturally increases the cost of the side part.

while it is necessary that the driving means which outside the side part carries the power input is arranged in positive guiding means serving as additional housing, the housing is not necessay for realizing the solution to the problem involved. According to a further development of the invention, it has therefore been attempted so to design a side part for the mounting of the roller of a jalousie with a driving means on the outside of the side part in an independent housing and a positive guiding means for said housing, in such a way that on one hand a local movability of the driving or transmission means mounted in an independent housing will be possible while on the other hand material will be saved and thereby the cost of the side part will be reduced. This will be realized in confomity with a further development of the invention by so designing the positive guiding means that the latter comprises angle rails which form a unit with the side part or is connectable thereto. The positive guiding means may, according to the invention, consist of U-rails forming a unit with the side part or be detachably connected thereto. Instead of the U-rails, according to the invention also flat webs may be employed which are provided with grooves engaged by extensions on the transmission housing of the transmission or driving device, said extensions conforming with the shape of said grooves. The flat web may, according to a further development of the invention comprise outwardly directed extensions of a corresponding profile which engage with correspondingly profiled guiding means on the transmission housing. Furthermore, the positive guiding means of the side part may, in conformity with the invention, comprise groove-shaped elements located opposite to each other which receive the self-locking transmission mounted in a separate housing.

The characteristic feature of this further development consists in that a separate housing is no longer necessary for the self-locking transmission arranged outside the side part but instead the transmission arrangement is guided in two oppositely located elements which may be of different shape and is held therein. It is also advantageous that considerably less material is necessary for the guiding means of the transmission arrangement. In addition thereto, the positive guiding means also make it possible to displace the transmission arrangement outside the side part in axial direction of the jalousie roller or parallel thereto because the power or force introduced through the transmission means is, through the intervention of an intermediate shaft, conveyed to the gears within the side part. As a result thereof, there is created the possibility to adapt the power input to the respective installation conditions while the material necessary for the side part is kept at a minimum. In this way, additional working operations frequently necessary with already existing buildings will be avoided.

FIGS. 36 to 42 illustrate embodiments of this inventive. feature in more detail. As will be seen from FIGS. 36 and 37, the jalousie roller 148 is journaled in the side part 147. The jalousie is adapted to be rolled up on said roller shaft 148. connected to the roller shaft 148 is a gear 149 which cooperates with a smaller spur gear 150. Spur gear 150, is, through intermediate shaft 152*a*, connected to the driving arrangement transmission 152 located outside the side part 147. Shaft 152*a* may be of a hexagonal, rectangular or similar cross section. The transmission or driving arrangement 152 is self-locking and guided in positive guiding means in which it is held. The positive guiding means may, in conformity with FIG. 36, comprise oppositely located angle rails 154 which with the side part 147 form a single unit. These angle rails may, however, also be screwed onto the side part 147 or may be welded thereto.

According to FIG. 38, the automatic guiding means is formed by oppositely located U-rails 155.

FIG. 39 shows that the positive guiding means may consist of oppositely located flat webs 156 with grooves 157, which grooves are engaged by extensions 158 which are designed in conformity with the shape of said grooves. These extensions 158 are located on the transmission housing 159 of the housing arrangement 152 located outside the side part 1.

FIG. 40 shows the reverse arrangement according to which the positive guiding means is built up of oppositely located profiled rails 160 which engage correspondingly profiled guiding means 161 on the transmission housing 162 of the transmission arrangement mounted outside the side part 1.

The embodiment of FIG. 41 shows a forced guiding means which comprises elements 163 located opposite to each other having axially displaceably mounted therebetween a transmission arrangement 152.

The embodiment of FIG. 42 shows that narrow strips 164 may be employed which are located opposite to each other and which engage corresponding recesses 165 provided in the transmission housing 162. In this way there is likewise provided a forced guiding means for the transmission arrangement 152.

Not only the forced guiding means according to FIG. 41 but also the forced guiding means of the remaining FIGS. furnish the possibility of an axial displacement of the transmission 152.

As mentioned above, there exists the possibility of producing the forced guiding means (which may be made of different designs) together with the lateral part 147 as a unit. For instance, this unit may be cast or may be created by connecting the forced guiding means later to the lateral part 147, for instance, by welding or by connecting screws. It is, however, most expedient to produce the lateral part together with the forced guiding means as a unit. With various transmission elements, the power input is located outside the lateral confining elements of the jalousie. This has the advantage that a good adaptation of the jalousie system to the frequently different local installation conditions will be possible. Frequently it is necessary to place the power input to the transmission elements farther away than usually from the lateral confining elements of the jalousie. Sometimes, additionally, the angular position of the power input has to be adapted to or be made in conformity with the wall surface. The adaptation of the power input and thereby of the power transmission elements to a certain angular position favorable with regard to the wall surface can, however, not be realized with certain constructions or only by using additional equipment. It is, therefore, a further object of the present invention to provide a driving device for jalousies according to which the power input may selectively together with the power transmission elements be moved into a favorable position regardless of the local conditions of installation.

According to the present invention, it is further suggested to insert a further housing for receiving the power transmitting elements into a preferably cylindrical housing which is selectively connected on the outside with the lateral confining elements of the jalousie, and to provide a longitudinally extending recess in the housing which is selectively connectable to the lateral confining surfaces of the jalousie. The width of said last mentioned longitudinally extending recess is so dimensioned that the power input selectively together with the power transmitting elements arranged in said separate housing is tiltable from its cental position upwardly and downwardly by at least 45° about an intermediate shaft.

As power transmitting elements there may be employed, for instance, bevel gear transmissions or worm wheel transmissions while in particular when employing the worm wheel transmission a self-locking effect is advantageously obtained. However, also other power transmitting elements may be employed which, together with the tilting of the power transmitting elements, at the same time permit a tilting of the power input.

The advantage realized with the present invention consists in that independently of the locally frequently varying conditions of installation, the driving device for a jalousie, especially an outside jalousie can be installed without any difficulties.

with reference to FIG. 43, it will be seen that adjacent the lateral confining element 166 of the jalousie there is on the outside provided a preferably cylindrical housing 167 having arranged therein the power transmitting elements, for instance, in the form of a bevel gear transmission or a worm gear transmission and mounted in a seperate housing 168. By these transmissions, the input power is conveyed to the driving mechanism for the jalousie through the intervention of an intermediate shaft 170. The power input 169 to the power transmission elements in the separate housing 168 is, together with housing 168, pivotable about an intermediate shaft 170. The pivoting of the power input 169 with the transmission elements in housing 168 is possible in view of a recess 171 extending along and in the housing 167. The width B of this recess 171 (see FIG. 44) may be such that a pivoting of the power input 169 with the power transmission elements 168 about the intermediate shaft 170 by an angle of at least 45° will be possible in upward or downward direction from the central position.

A jalousie driving device for lifting, lowering, and braking of jalousies has become known which comprises a crown wheel transmission, a ball or cross joint with a foldable crank bar. Such jalousie driving devices are employed particularly where jalousies are mounted in front of the masonry. Heretofore, jalousies of this type were actuated in most instances by means of a strap. While the strap actuation is ideal when the jalousies are on the inside of the building, the strap actuation becomes rather awkward when the jalousie is mounted an the outside of the building because the strap has to be passed through the window and through the masonry. It is for this reason that actuation by straps has been replaced by a jalousie driving device comprising a crown wheel and a drive wheel. The drive wheel is driven by means of a crank bar including preferaly a ball or cross joint and thus puts into motion the crown wheel and thereby the jalousie. Even though the driving wheel can, as far as its position is concerned, by pivoting be adapted to the various abutment possibilities as they prevail in particular with older buildings, for the windows in the masonry, there also exists cases in which the driving wheel is not accessible from the room through the crank bar or the crank bar has to be installed in an unfavorable position at the window.

It is a further object of this invention to design the driving device, particularly with regard to the driving wheels in such a way that even under rather unfavorable conditions an unimpeded drive through the crank rod will be possible. This object has been realized according to the present invention by making the crown wheel rotatable through the intervention of a plurality of driving wheels located in a single housing in one place, one behind the other. The driving wheels may, according to the invention, all have the same number of teeth. The driving wheels, may, however, according to a further development of the invention, be so designed with regard to the number of teeth that the driving wheel which meshes with the crown wheel has a lower or higher number of teeth than the connecting wheels.

Each of the individual driving wheels is, according to the invention, centrally provided with a recess, preferably of a square or hexagonal contour into which the drive crank may be introduced.

Due to the fact that a plurality of driving wheels are located in a single housing in one plane, one behind the other, the individual driving wheels are easily accessible by the drive crank.

If, for instance, the driving wheel which directly meshes with the crown wheel cannot be reached by the crank in view of an unfavorable window construction, it is possible, for instance, to drive the adjacent driving wheel or another wheel through the intervention of the crank.

The possibility of adapting the jalousied driving device to the various conditions of a window may, according to a further development of the invention, still be further improved by having the driving wheels of the crown wheel together with their housing pivotably arranged for pivotably in bearing means connected to the crowned wheel housing, by an angle $\alpha$.

The individual driving wheels arranged in a single housing are journaled in anti-friction bearings or in cups of synthetic material or in bushings of synthetic material. These journaling possibilities have proved highly satisfactory in practice.

For purposes of pivoting the housing of the driving wheels, it is expedient for assuring a proper power transmission, to correspondingly design in particular the teeth of the driving wheel meshing with the crown wheel. Within the framework according to the invention it is further suggested that the teeth of the drive wheel meshing with the crown wheel are arched outwardly, whereas the teeth of the adjacent drive wheels may selectively be arched outwardly or inwardly.

The housing for the driving wheels of the crown wheel may be made of synthetic material or may be cast. The housing is adapted to be closed at one said by means of a lid.

Depending on the size of the driving wheels which selectively differ in diameter, the housing may be stepped in conformity with the diameter of the driving wheels.

Referring now to FIGS. 45–51, it will be noticed that the crown wheel 172 is rotatably journaled in housing 179. The drive of the crown wheel is effected through driving wheels 173, 173′, 173″, which are located in a single housing 174 in one plane, one after another. The driving wheel 173 protrudes from housing 174 as will be particularly evident from FIGS. 47–49, and through a bore 180 in the crown wheel housing 179 extends into the crown wheel 172.

The driving wheels 173, 173′, 173″, of FIG. 47 have the same number of teeth. The driving wheels of the design according to FIG. 48, however, have different numbers of teeth. With the embodiment of FIG. 49, only the driving wheel 171 is provided with a smaller number of teeth than the following driving wheels 173′, 173″, and 173 ‴. All driving wheels 173, 173′, 173′, and 173 ‴, are centrally provided with a recess 175 of a preferably square or hexagonal contour. In order further to increase the adaptability of the jalousie driving device according to the invention in conformity with the respectively prevailing local conditions, the housing 174 is by an angle $\alpha$ pivotally journaled in bearing means 177 connected to the crown wheel housing 179.

FIGS. 50 and 51 illustrate two fundamentally different possibilities of journaling the individual driving wheels 173, 173′, 173″, and 173‴. FIG. 50 shows in section how a driving wheel may be journaled in a cup or bushing of synthetic material. FIG. 51 shows the journaling of the wheel in an anti-friction bearing, and more specifically, in a ball bearing.

The teeth of the driving wheel 173 which meshes with the crown wheel 172 are arched outwardly, as shown in particular in FIG. 46.

The connecting wheels 173′, 173″, likewise have outwardly arched gears, as shown in FIG. 46. The adjacent or connecting gears may, however, also have inwardly arched gears or gears with outwardly arched teeth may alternate with gears having inwardly arched teeth. Housing 174 in which the individual driving wheels 173, 173′, 173″, and 173‴ are located, may, as will be evident in particular from FIG. 50 unilaterally be closed by a cover or lid 178 while one bearing for the driving wheel may be located in said cover or lid. The housing design according to FIG. 51, however, consists of two equal housing parts in which the bearing areas are provided. The shape of the housing 174 may, as will be evident in particular from FIGS. 48 and 49 be stepped in conformity with the different diameters of the individual driving wheels 173, 173′, 173″, and 173‴.

The jalousie driving device according to the present invention also has the advantage that it can be considerably better adapted to the local conditions of installation.

It is, of course, to be understood that the present invention is, by no means, limited to the particular showing in the drawings, but also comprises any modifications within the scope of the appended claims.

What is claimed

1. In combination on a rolling closure for a wall opening: a box having end walls, a shaft extending along said box and rotatingly supported by said end walls, a flexible shield having one end connected to said shaft and adapted to be rolled up on the shaft by rotation of the shaft, and a guiding frame guidingly engaging the lateral edges of said shield, said guiding frame being connected to said box and forming an assembly therewith adapted to be mounted as a unit in operative relation to the wall opening, actuating means for driving said shaft, an adjustably mounted transmission outside one of said end walls connecting said actuating means to said shaft and having a housing, and support rails on said one end wall supportingly engaging said housing and providing guiding means therefor, said guiding means being in the form of opposed U shaped support rails.

2. In combination on a rolling closure for a wall opening according to claim 1 in which said guiding means are profiled and said housing is profiled in a complementary manner to fit said rails.

3. In a rolling closure for a wall opening: a box having end walls, a shaft extending along said box and rotatingly supported by said end walls, a flexible shield having one end connected to said shaft and adapted to be rolled up on the shaft by rotation of the shaft, and a guiding frame guidingly engaging the lateral edges of said shield, said guiding frame being connected to said box and forming an assembly therewith adapted to be mounted as a unit in operative relation to the wall opening, actuating means for driving said shaft, a transmission outside one of said end walls connecting said actuating means to said shaft and having a housing, support rails on said one end wall supportingly engaging said housing and providing guiding means therefor, said guiding means being in the form of opposed U-shaped support rails, said guiding means being flat parallel members, grooves in the opposed faces of said members, and ribs on said housing engaging said grooves.

* * * * *